US008819965B2

(12) United States Patent
Baker et al.

(10) Patent No.: US 8,819,965 B2
(45) Date of Patent: Sep. 2, 2014

(54) ARTICLE OF FOOTWEAR WITH SUSPENDED STUD ASSEMBLY

(75) Inventors: Brian D. Baker, Portland, OR (US); Alexandre Baudouin, Portland, OR (US); Erez Morag, Lake Oswego, OR (US)

(73) Assignee: NIKE, Inc., Beaverton, OR (US)

( * ) Notice: Subject to any disclaimer, the term of this patent is extended or adjusted under 35 U.S.C. 154(b) by 162 days.

(21) Appl. No.: 13/482,407

(22) Filed: May 29, 2012

(65) Prior Publication Data

US 2012/0233887 A1 Sep. 20, 2012

Related U.S. Application Data

(62) Division of application No. 12/361,660, filed on Jan. 29, 2009, now Pat. No. 8,220,185.

(51) Int. Cl.

| | |
|---|---|
| ***A43C 15/02*** | (2006.01) |
| ***A43C 15/16*** | (2006.01) |
| ***A43B 5/02*** | (2006.01) |
| ***A43B 13/22*** | (2006.01) |

(52) U.S. Cl.

CPC ..... *A43C 15/161* (2013.01); *A43C 15/168* (2013.01); *A43B 5/02* (2013.01); *A43B 13/223* (2013.01)

USPC ..... 36/134; 36/126; 36/128

(58) Field of Classification Search

CPC .... A32C 15/161; A32C 15/168; A32C 15/16; A43B 5/223; A43B 13/26; A43B 13/22; A43B 13/24

USPC ..... 36/134, 126, 128

See application file for complete search history.

(56) References Cited

U.S. PATENT DOCUMENTS

| | | | | |
|---|---|---|---|---|
| 2,048,683 | A | 7/1936 | Brockman | |
| 2,444,865 | A | 7/1948 | Warrington | |
| 3,739,500 | A | 6/1973 | Cox | |
| 3,822,490 | A | 7/1974 | Murawski | |
| 4,470,207 | A * | 9/1984 | Bente | 36/134 |
| 5,138,776 | A | 8/1992 | Levin | |
| 5,377,431 | A * | 1/1995 | Walker et al. | 36/134 |
| 6,487,796 | B1 | 12/2002 | Avar et al. | |
| 6,694,642 | B2 | 2/2004 | Turner | |

(Continued)

FOREIGN PATENT DOCUMENTS

| | | |
|---|---|---|
| EP | 356637 A1 * | 3/1990 |
| WO | 2007044451 | 4/2007 |
| WO | 2007143443 | 12/2007 |

OTHER PUBLICATIONS

Invitation to Pay Additional Fees and International Search Report mailed Nov. 25, 2010 in International Application No. PCT/US2010/022337.

(Continued)

*Primary Examiner* — Ted Kavanaugh

(74) *Attorney, Agent, or Firm* — Plumsea Law Group, LLC

(57) ABSTRACT

An article of footwear with a suspended stud assembly attached to a sole is disclosed. The suspended stud assembly includes a base portion attached to the sole of a shoe. A set of suspension arms connect a plurality of studs to the base portion. This arrangement allows the studs to move independently of the sole and of each other to provide greater traction capabilities to the article of footwear.

14 Claims, 16 Drawing Sheets

(56) References Cited

U.S. PATENT DOCUMENTS

| | | | | |
|---|---|---|---|---|
| 6,834,445 | B2 | 12/2004 | McMullin | |
| 6,925,732 | B1 | 8/2005 | Clarke | |
| 6,964,119 | B2 | 11/2005 | Weaver, III | |
| 7,134,226 | B2 | 11/2006 | Robinson, Jr. et al. | |
| 7,159,339 | B2 | 1/2007 | Mathieu et al. | |
| 7,194,826 | B2 | 3/2007 | Ungari | |
| 7,395,616 | B2 | 7/2008 | Fallon | |
| 7,600,333 | B2 | 10/2009 | Robinson, Jr. et al. | |
| 7,726,047 | B1 | 6/2010 | MacNeill et al. | |
| 8,316,562 | B2 * | 11/2012 | Locke et al. | 36/67 R |
| 2002/0144430 | A1 | 10/2002 | Schmid | |
| 2005/0072026 | A1 | 4/2005 | Sink | |
| 2005/0102857 | A1 | 5/2005 | Yen | |
| 2005/0102858 | A1 | 5/2005 | Yen | |
| 2005/0102859 | A1 | 5/2005 | Yen | |
| 2005/0120592 | A1 | 6/2005 | Rodriguez | |
| 2005/0172518 | A1 | 8/2005 | Ungari | |
| 2008/0072459 | A1 | 3/2008 | Robinson et al. | |
| 2008/0256827 | A1 | 10/2008 | Hardy et al. | |
| 2010/0186261 | A1 | 7/2010 | Baker et al. | |

OTHER PUBLICATIONS

The International Search and Written Opinion mailed Jan. 24, 2011 in International Application No. PCT/US2010/022337.

International Preliminary Report on Patentability (including Written Opinion of the ISA) mailed Aug. 11, 2011 in International Application No. PCT/US2010/022337.

Chinese Office Action issued on Nov. 21, 2013 in CN Application No. 201080015529.0.

* cited by examiner

ARTICLE OF FOOTWEAR WITH SUSPENDED STUD ASSEMBLY

CROSS-REFERENCE TO RELATED APPLICATION

This application is a divisional of Baker et al., U.S. Patent Application Publication No. 2010/0186261, published on Jul. 29, 2010, the entire disclosure of which is incorporated herein by reference.

BACKGROUND OF THE INVENTION

1. Field of the Invention

The present invention relates to an article of footwear, and in particular to a sports shoe with a suspended stud assembly.

2. Description of Related Art

Stud assemblies have been previously proposed. Ungari (U.S. Pat. No. 7,194,826) teaches a sole structure with a pivoting cleat assembly. Ungari teaches a pivoting cleat assembly for an article of footwear such that the medial and lateral portion of the cleat assembly can move upwardly and downwardly with respect to the sole. Ungari teaches a plurality of recesses formed in a lower surface of a sole. Each recess is configured to receive at least a portion of a cleat assembly. When a user's leg is angled toward the medial side of the footwear, a medial portion of the base member pivots upwardly into a recess, while the sole is angled toward the medial side. Furthermore, even though the leg and the sole are angled inwardly toward the medial side, both cleats of the cleat assembly remain fully engaged and in contact with the ground, enhancing traction for the user.

SUMMARY OF THE INVENTION

The invention discloses an article of footwear with a suspended stud assembly. The article of footwear may be associated with one or more studs of a suspended stud assembly. The term "stud" as used throughout this detailed description and in the claims refers to a projection of a suspended stud assembly that is configured to engage a ground surface and penetrate or interweave with that surface. Examples of ground surfaces include, but are not limited to: natural turf, synthetic turf, dirt, as well as other surfaces. It should be understood that the term "stud" is not limited to a portion of a suspended stud assembly that penetrates through a ground surface. In some cases, as with Astroturf, a stud may only interweave with various fibers associated with the turf, and may not penetrate through the Astroturf.

In one aspect, the invention provides an article of footwear, comprising: a sole; a suspended stud assembly attached to a portion of the sole and configured to provide traction for the sole; the suspended stud assembly including a stud configured to penetrate through a ground surface; the suspended stud assembly further including a suspension arm configured to connect the stud to a base portion of the suspended stud assembly; and where the motion of the suspension arm allows the stud to move substantially independently from the sole.

In another aspect, the invention provides an article of footwear, comprising: a sole; a suspended stud assembly attached to a portion of the sole and configured to provide traction for the sole; the suspended stud assembly including a first suspension arm attached to a base portion of the stud assembly, the first suspension arm including a first stud configured for traction; the suspended stud assembly including a second suspension arm attached to the base portion of the suspended stud assembly, the second suspension arm including a second stud configured for traction; and where the first stud is configured to move substantially independently of the second stud.

In another aspect, the invention provides an article of footwear, comprising: a sole; a suspended stud assembly attached to a portion of the sole and configured to provide traction for the sole; the suspended stud assembly including a stud configured to penetrate through a ground surface; the suspended stud assembly further including a suspension arm configured to connect the stud to a base portion of the suspended stud assembly; an insert configured for insertion between the base portion and the suspension arm; and where the suspension arm is configured to undergo a first degree of deflection when the insert is inserted into the suspended stud assembly and wherein the suspension arm is configured to undergo a second degree of deflection when the insert is removed from the suspended stud assembly.

In another aspect, the invention provides an article of footwear, comprising: a sole including a base portion; a stud extending from the base portion; the stud including a first end portion and a second end portion; and where the first end portion is configured to move substantially independently of the first end portion.

In another aspect, the invention provides an article of footwear comprising: a sole including a base portion; a stud extending from the base portion; the stud including a first end portion disposed adjacent to the base portion and a second end portion disposed opposite of the first end portion and configured to contact a ground surface, the stud further including an intermediate portion disposed between the first end portion and the second end portion; the stud including an integral stud portion and a stud insert; and where the stud insert extends from the intermediate portion to the base portion and wherein a portion of the stud insert is exposed on an upper surface of the base portion.

Other systems, methods, features and advantages of the invention will be, or will become apparent to one with skill in the art upon examination of the following figures and detailed description. It is intended that all such additional systems, methods, features and advantages included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION OF ONE EMBODIMENT

Figure 1:
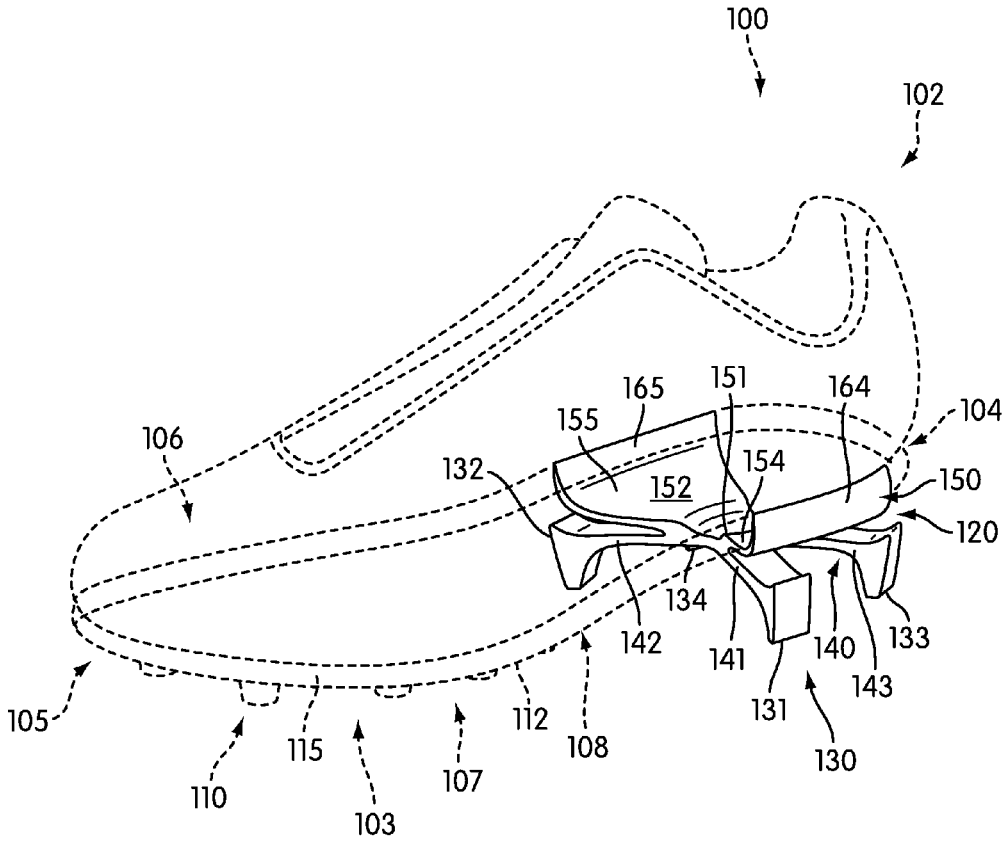
FIG. 1 is an isometric view of an exemplary embodiment of a suspended stud assembly associated with an article of footwear illustrated in phantom.

FIG. 1 illustrates a phantom view of an exemplary embodiment of article of footwear 100. For clarity, the following detailed description discusses an exemplary embodiment, in the form of a football shoe, but it should be noted that the present invention could take the form of any article of footwear including, but not limited to: hiking boots, soccer shoes, football shoes, sneakers, rugby shoes, baseball shoes as well as other kinds of shoes. As shown in FIG. 1, article of footwear 100, also referred to simply as article 100, is intended to be used with a left foot; however, it should be understood that the following discussion may equally apply to a mirror image of article of footwear 100 that is intended for use with a right foot.

Article of footwear 100 includes upper 102. Upper 102 is configured to receive a foot of a wearer of article 100. Generally, upper 102 may be any type of upper. In particular, upper 102 could have any design, shape, size and/or color.

Article of footwear 100 also includes sole 105. In different embodiments, sole 105 may include different components. For example, sole 105 may include an outsole, midsole and/or insole.

Sole 105 includes lower surface 112. Lower surface 112 can be configured to contact a ground surface. Examples of ground surfaces include, but are not limited to: natural turf, synthetic turf, dirt, as well as other surfaces.

In some embodiments, sole 105 includes forefoot portion 103. Forefoot portion 103 may be associated with a forefoot of a foot inserted within article 100. Similarly, sole 105 includes heel portion 104 that may be associated with a heel of a foot inserted within article 100. Sole 105 also includes arch portion 108. Arch portion 108 may be disposed between forefoot portion 103 and heel portion 104.

Sole 105 can also comprise medial portion 106. Medial portion 106 may be associated with an inside of a foot. Likewise, sole 105 can comprise lateral portion 107 disposed opposite of medial portion 106. Lateral portion 107 may be associated with an outside of a foot.

In some embodiments, sole 105 may be configured with outer peripheral edge 115. The term "outer peripheral edge" as used throughout this detailed description and in the claims refers to an outer portion of a sole that extends from a lower surface of a sole to an upper of an article. For example, outer peripheral edge 115 extends between upper 102 and lower surface 112. With this configuration, outer peripheral edge 115 circumscribes sole 105.

A sole of an article of footwear can include provisions for increasing traction with a ground surface. In some embodiments, a sole may include traction elements that engage a ground surface. In other embodiments, a sole may include cleats that penetrate a ground surface to provide traction. In some cases, cleats may be integrally formed with a sole. In other cases, cleats may be attached to a sole. In still other embodiments, a sole may be associated with a suspended stud assembly configured to provide traction for a sole.

Figure 2:
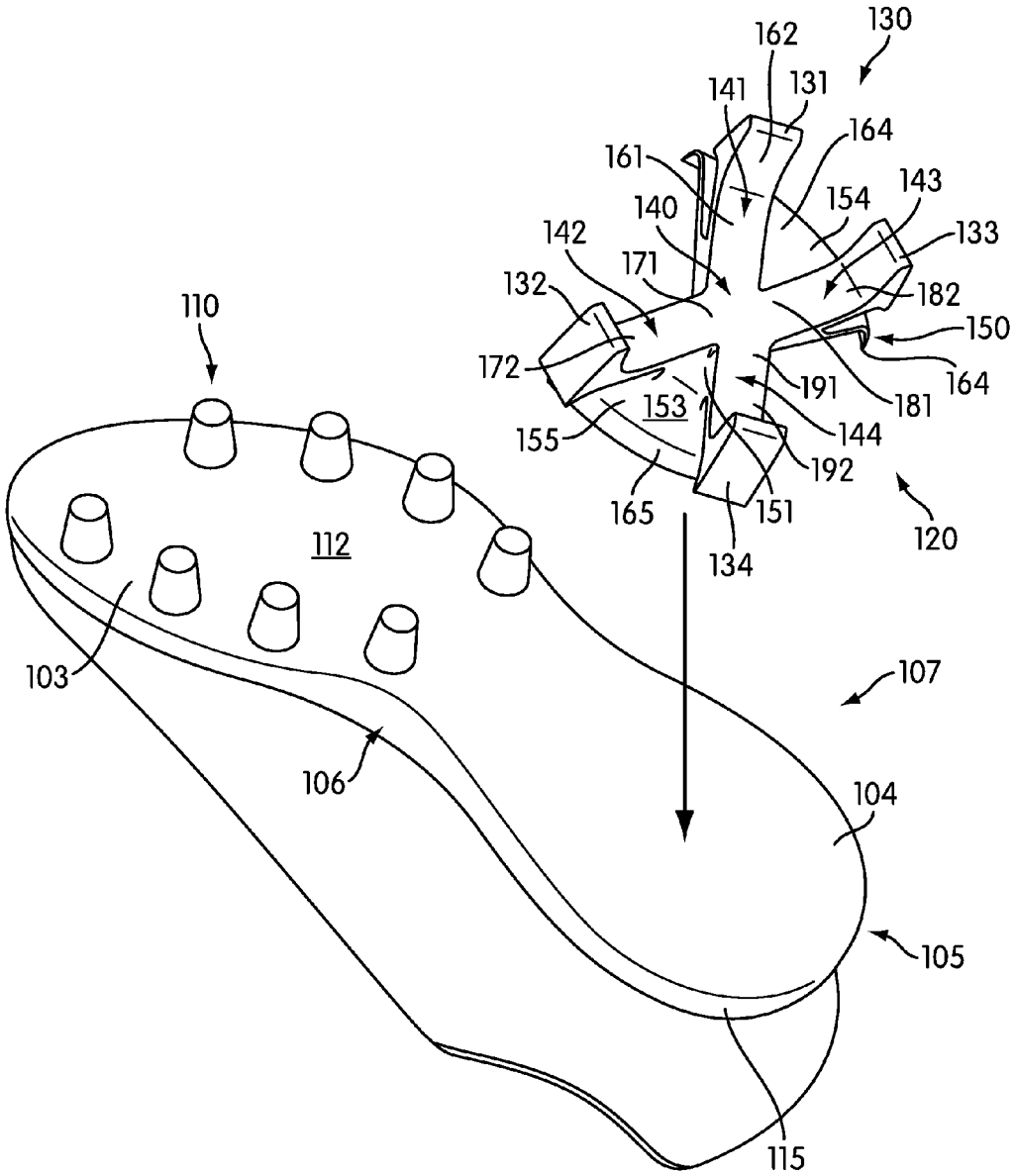
FIG. 2 is a bottom isometric view of an exemplary embodiment of an article of footwear associated with a suspended stud assembly.
Figure 3:
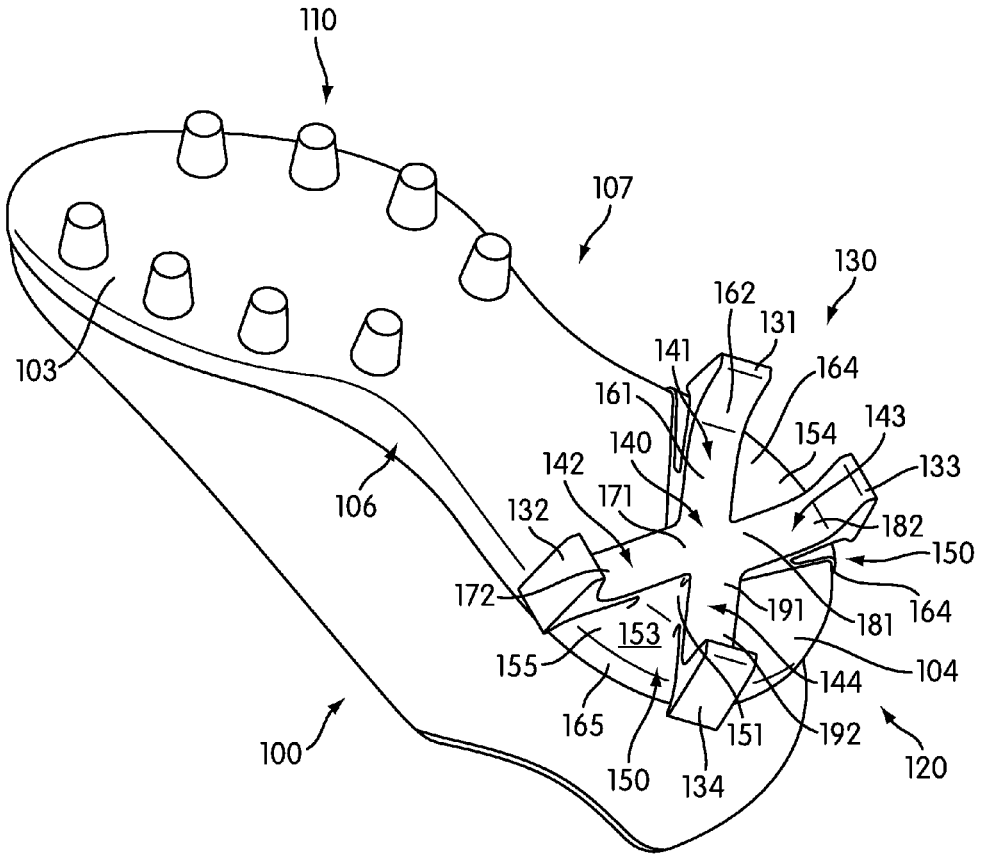
FIG. 3 is a bottom isometric view of an exemplary embodiment of a suspended stud assembly attached to an article of footwear.

Referring to FIGS. 1-3, sole 105 may be associated with suspended stud assembly 120. In some embodiments, suspended stud assembly 120 can be associated with forefoot portion 103. In other embodiments, suspended stud assembly 120 can be associated with arch portion 108. In an exemplary embodiment, suspended stud assembly 120 may be associated with heel portion 104.

Suspended stud assembly 120 includes plurality of studs 130. The term "stud" as used throughout this detailed description and in the claims refers to a projection of a suspended stud assembly that is configured to engage a ground surface and penetrate or interweave with that surface. In some embodiments, the term "stud" may refer to a cleat. In other embodiments, the term "stud" may refer to a ground engaging member that engages a ground surface to provide traction. In one embodiment, plurality of studs 130 may be configured to penetrate through a ground surface to provide traction.

In different embodiments, studs of plurality of studs 130 may be configured in various shapes. Examples of shapes include, but are not limited to: cylindrical, shark-fin, wedge, rounded and various prism shapes. In an exemplary embodiment, studs of plurality of studs 130 may be configured in wedge-like shapes.

Generally, plurality of studs 130 may comprise various numbers of studs. In some embodiments, plurality of studs 130 may include more than four studs. In other embodiments, plurality of studs 130 may include less than four studs. In one embodiment, plurality of studs 130 includes four studs. In particular, plurality of studs 130 comprises first stud 131, second stud 132, third stud 133 and fourth stud 134.

In different embodiments, plurality of studs 130 may be arranged in various patterns associated with different portions of sole 105 including, a peripheral portion of sole 105, a central portion of sole 105, lateral portion 107 of sole 105 and/or medial portion 106 of sole 105. In one embodiment, plurality of studs 130 may be arranged in a square-like pattern. For example, first stud 131 and third stud 133 may be associated with a lateral portion 107 of heel portion 104 of sole 105. In particular, first stud 131 and third stud 133 may be aligned in a substantially longitudinally direction along lateral portion 107. The term "longitudinal" as used throughout this detailed description and in the claims refers to a direction extending a length of an article. In a similar manner, second stud 132 and fourth stud 134 may be aligned in a substantially longitudinal direction along medial portion 106. Furthermore, first stud 131 and second stud 132 may be associated with a forward portion of heel portion 104 that is disposed closer to arch portion 108. In some cases, first stud 131 and second stud 132 may be aligned in a substantially lateral direction on a forward portion of heel portion 104. The term "lateral" as used throughout this detailed description and in the claims refers to a direction extending a width of an article. Likewise, third stud 133 and fourth stud 134 may be associated with a rearward portion of heel portion 104 that is disposed further away from arch portion 108. In particular, third stud 133 and fourth stud 134 may be aligned in a substantially lateral direction. Using this configuration, plurality of studs 130 may be arranged in a square-like pattern to increase traction for article 100.

In some embodiments, a plurality of studs can be fixedly attached to a sole. However, in some cases, fixedly attaching a plurality of studs to a sole can prevent independent movement of the studs. Without independent movement of the studs, the plurality of studs may provide less traction to an article of footwear. For example, studs may lose contact with a ground surface when an article is leaned to a side if studs do not include provisions for independent movement. In some cases, a set of suspension arms may be configured to allow independent movement of the plurality of studs. The set of suspension arms may be connected to a base portion. The base portion may be fixedly attached to a sole. With this arrangement, the plurality of studs can be attached to a sole and move independently of each other and the sole to provide greater traction.

Referring to FIGS. 1-3, suspended stud assembly 120 includes set of suspension arms 140 and base portion 150. Set of suspension arms 120 includes plurality of studs 130. Furthermore, set of suspension arms 140 are attached to base portion 150 of suspended stud assembly 120. With this arrangement, plurality of studs 130 may be connected to sole 105 but move substantially independently of sole 105.

Generally, set of suspension arms 140 may connect plurality of studs 130 to any portion of base portion 150. In some embodiments, set of suspension arms 140 may be attached to central portion 151 of base portion 150. In other embodiments, however, set of suspension arms 140 may be connected to another portion of base portion 150. For example, in some cases, suspension arms of set of suspension arms 140 may be individually connected or connected in subsets to portions of base portion 150. By connecting set of suspension arms 140 to central portion 151 of base portion 150, set of suspension arms 140 may be configured to move independently of sole 105.

In some embodiments, set of suspension arms 140 may include a fewer number of suspension arms than the number of studs of plurality of studs 130. In some cases, a suspension arm of set of suspension arms 140 may connect more than one stud of plurality of studs 130 to base portion 150. In other embodiments, set of suspension arms 140 may include the same number of suspension arms as the number of studs of plurality of studs 130. This arrangement can allow each suspension arm to attach one stud to base portion 150. Using this configuration, studs of plurality of studs 130 may move substantially independently of each other.

In one embodiment, set of suspension arms 140 includes first suspension arm 141, second suspension arm 142, third suspension arm 143 and fourth suspension arm 144 to attach plurality of studs 130 to base portion 150. In particular, first suspension arm 141 may be configured to attach first stud 131 to base portion 150. In some cases, first suspension arm 141 may include first end portion 161 and second end portion 162. First end portion 161 may be connected to central portion 151 while second end portion 162 is connected to first stud 131. In a similar manner, second suspension arm 142 may connect second stud 132 to base portion 150. In particular, first end portion 171 of second suspension arm 142 may be connected to central portion 151 and second end portion 172 may be connected to second stud 132. Likewise, third suspension arm 143 can connect third stud 133 to base portion 150. This can be accomplished by connecting first end portion 181 of third suspension arm 143 to central portion 151 and connecting second end portion 182 of third suspension arm 143 to third stud 133. Finally, fourth suspension arm 144 can connect fourth stud 134 to base portion 150. In particular, first end portion 191 of fourth suspension arm 144 can be connected to central portion 151 and second end portion 192 of fourth suspension arm 144 can be connected to fourth stud 134. With this arrangement, set of suspension arms 140 may connect plurality of studs 130 to central portion 151 of base portion 150 in a manner that allows substantially independent movement of plurality of studs 130 from each other and sole 105.

In different embodiments, base portion 150 may be configured with various shapes. In some embodiments, base portion 150 may comprise a shape that corresponds with a portion of sole 105. For example, base portion 150 may be configured in a shape that corresponds with heel portion 104. In other embodiments, base portion 150 can comprise a shape to project over set of suspension arms 140. In some cases, base portion 150 may be shaped to project over each suspension arm of set of suspension arms 140 but not between the suspension arms. In other cases, base portion 150 may be shaped to project over and between set of suspension arms 140.

In one embodiment, base portion 150 may be configured in a butterfly-like shape that projects over set of suspension arms 140. In particular, base portion 150 may include first portion 154 and second portion 155. First portion 154 and second portion 155 may be separated by central portion 151. In some cases, first portion 154 may project over first suspension arm 131 and third suspension arm 133. Likewise, second portion 155 may project over second suspension arm 132 and fourth suspension arm 134. Using this configuration, base portion 150 may prevent set of suspension arms 140 from contacting lower surface 112 during independent movement of set of suspension arms 140.

In some embodiments, first portion 154 may include first side portion 164. First side portion 164 may curve upward from first portion 154. In particular, first side portion 164 can be configured to contact outer peripheral edge 115 of sole 105. Similarly, second portion 155 may include second side portion 165 that curves upward from second portion 155. Second side portion 165 may also be configured to contact outer peripheral edge 115 of sole 105.

A base portion of a suspended stud assembly can include provisions for attaching to a sole. Generally, a base portion of a suspended stud assembly may be attached to a sole in various manners known in the art. Examples of manners of attaching a base portion to a sole include, but are not limited to: adhesives, welding, as well as the use of fasteners such as nails, bolts or screws. Typically, a base portion may be fixedly attached to a sole. However, in other embodiments, the base portion may be removable from a sole. For example, the base portion may be removed from the sole by unfastening a fastener such as a screw. With a base portion attached to a portion of the sole, the movement of the base portion may be fixed with respect to the sole to provide stability for the suspended stud assembly.

Referring to FIGS. 1 and 3, base portion 150 may be attached to heel portion 104 of sole 105. In other embodiments, however, base portion 150 may be attached to another portion of sole 105. Using this arrangement, the movement of base portion 150 may be fixed with respect to sole 105 to provide stability for suspended stud assembly 120.

In different embodiments, different portions of base portion 150 may be attached to sole 105. In some embodiments, upper surface 152 of base portion 150 may be attached to sole 105. In some cases, only a portion of upper surface 152 may attach base portion 150 to sole 105. In one embodiment, first portion 154, first side portion 164, second portion 155 and second side portion 165 of base portion 150 may be attached to sole 105. With this arrangement, base portion 150 may be fixedly attached to lower surface 112 of sole 105 as well as a portion of outer peripheral edge 115. This arrangement allows the movement of base portion 150 to be fixed with respect to sole 105. Furthermore, this arrangement allows central portion 151 of base portion 150 to facilitate the independent movement of set of suspension arms 140 with respect to sole 105.

Although portions of suspended stud assembly 120 may move independently of each other and sole 105, it should be understood that base portion 150, set of suspension arms 140 and plurality of studs 130 form a substantially monolithic portion. In other words, base portion 150, set of suspension arms 140 and plurality of studs 130 are integrally formed. By integrally forming suspended stud assembly 120, suspended stud assembly 120 has a greater capacity to handle stresses caused by various movements without breaking. In particular, the integral formation of suspended stud assembly 120 substantially reduces frictional forces that may otherwise occur when separate portions continuously rub, bump or otherwise contact each other during use of suspended stud assembly 120. By reducing such frictional forces, the overall lifetime of suspended stud assembly 120 can be extended.

Generally, suspended stud assembly 120 can be constructed of any suitable material. In some cases, suspended stud assembly 120 can be constructed of a material with some elasticity to facilitate the movement of set of suspension arms 140 and plurality of studs 130. Examples include, but are not limited to: elastomers, siloxanes, natural rubber, other synthetic rubbers, aluminum, steel, other metals, thermoplastic polyurethane (TPU) or plastics.

In some embodiments, the elasticity of a material comprising suspended stud assembly 120 can vary over different portions of suspended stud assembly 120. For example, central portion 151 may be more flexible to allow set of suspension arms 140 to move independently of sole 105. In contrast, set of suspension arms 140 may be stiffer so that set of suspension arms 140 maintain the arrangement of plurality of studs 130 while allowing plurality of studs 130 to move independently of each other and sole 105.

In some embodiments, an article with a suspended stud assembly may include additional provisions for traction. In other words, a suspended stud assembly may be used in conjunction with additional provisions for traction. For example, if the suspended stud assembly is associated with a heel portion of an article, the article may include additional provisions for traction on a forefoot portion of the article. In some cases, the article may include additional provisions that engage a ground surface, such as traction elements. In other cases, the article can be configured with additional provisions that penetrate a ground surface, such as cleats.

Referring to FIGS. 1-3, article 100 includes set of cleats 110. In an exemplary embodiment, set of cleats 110 are disposed on forefoot 103. However, in other embodiments, set of cleats 110 may be disposed on another portion of sole 105. Using this arrangement, suspended stud assembly 120 and set of cleats 110 may work together to provide traction for article 100.

FIGS. 4-7 illustrate exemplary embodiments of athlete 401 standing upright as well as performing various maneuvers. Generally, athlete 401 may play any sport and may play any position. In these embodiments, athlete 401 may wear article 100 of the previous embodiment on a left foot. Similarly, athlete 401 may wear article 400 on a right foot.

Article 400 may be substantially similar to article 100 of the previous embodiment. In particular, suspended stud assembly 420 may be attached to sole 405 of article 400. With this arrangement, suspended stud assembly 420 can provide traction for sole 405.

Figure 4:
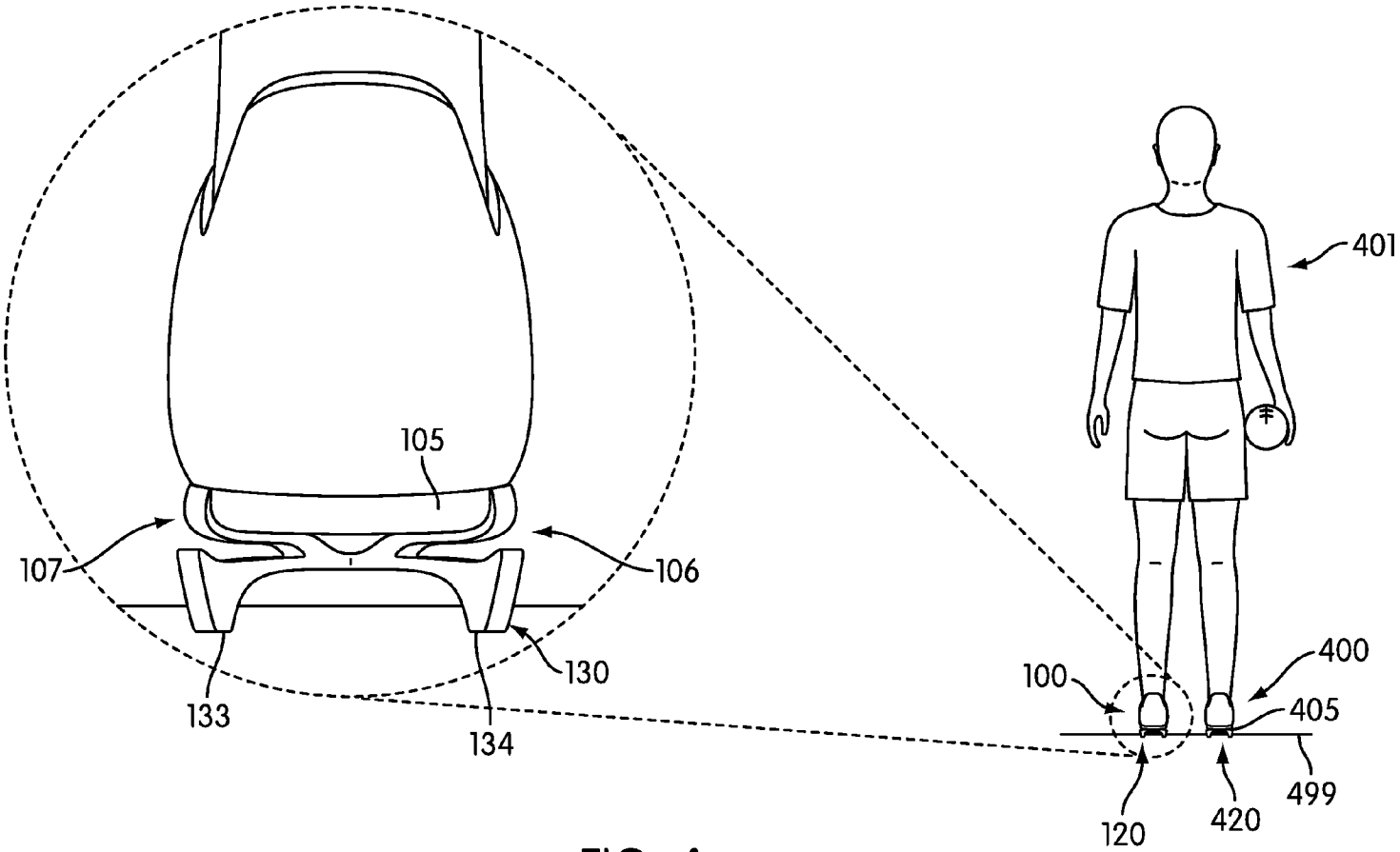
FIG. 4 is a schematic view of an exemplary embodiment of an athlete standing upright with an enlarged view of a suspended stud assembly attached to an article of footwear.

Referring to FIG. 4, athlete 401 is standing in an upright position. As athlete 401 stands upright, suspended stud assembly 420 and suspended stud assembly 120 provide traction for sole 405 and sole 105, respectively. For example, in an enlarged view, third stud 133 and fourth stud 134 penetrate through ground surface 499 as athlete 401 stands upright. It should be understood that the remaining studs of plurality of studs 130 as well as studs associated with suspended stud assembly 420 may also penetrate through ground surface 499 in a substantially similar manner. With this arrangement, suspended stud assembly 120 and suspended stud assembly 420 provide traction for sole 105 and 405, respectively.

During lateral maneuvers, an athlete may lean an article toward either a medial side or a lateral side of the article. Without provisions for independent movement, traction elements such as cleats may lose contact with a ground surface when the athlete performs a lateral maneuver. This may cause a loss of traction. A suspension system configured to provide substantially independent movement for one or more studs may continue to provide traction with a ground surface as an athlete performs a lateral maneuver.

Figure 5:
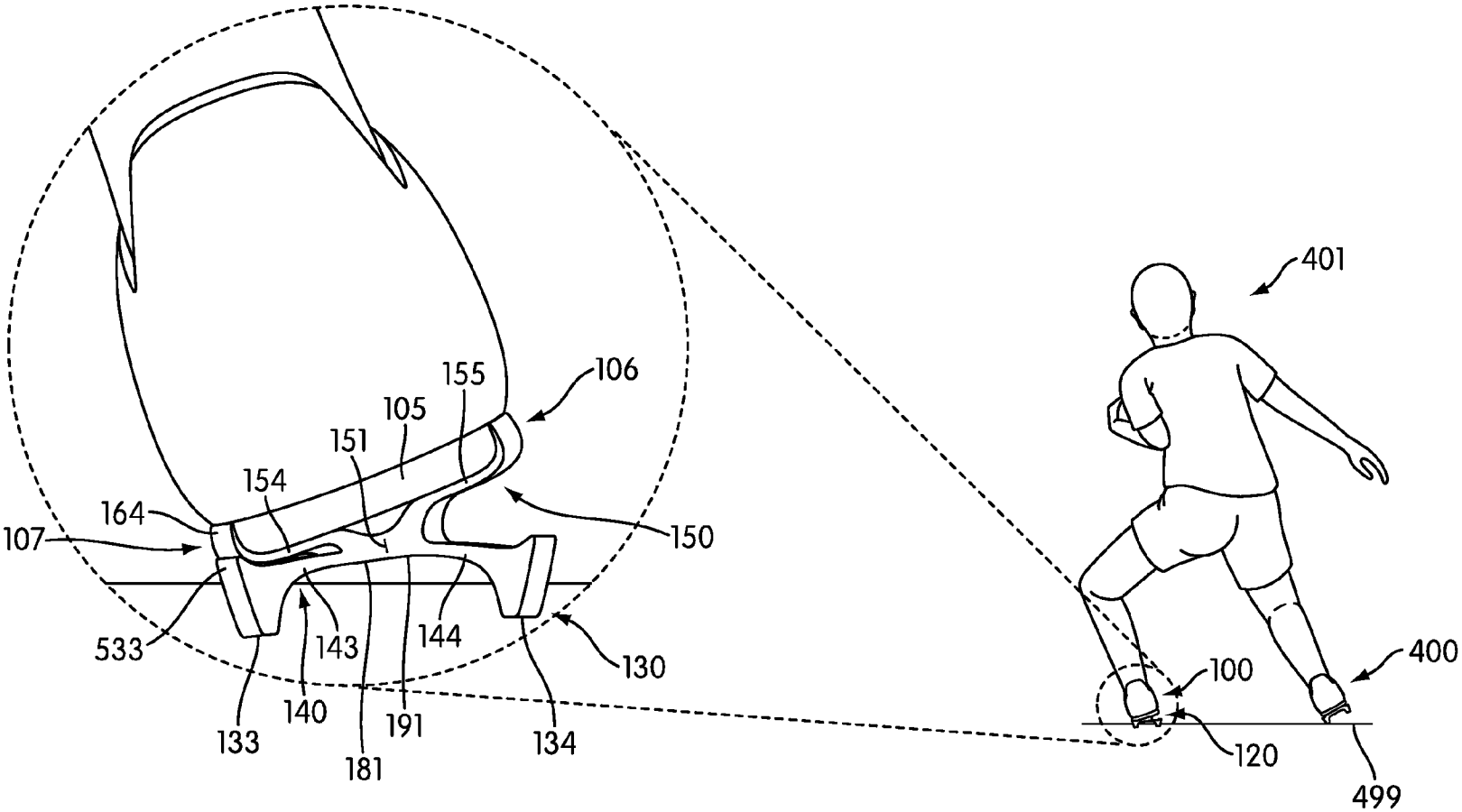
FIG. 5 is a schematic view of an exemplary embodiment of an athlete leaning toward a left side with an enlarged view of a suspended stud assembly attached to an article of footwear.

Referring to FIG. 5, athlete 401 performs a lateral maneuver moving toward a left side. As athlete 401 moves toward the left, article 400, associated with a right foot, may be elevated from ground surface 499. In addition, article 100, associated with a left foot, may lean toward lateral portion 107 of sole 105. This causes sole 105 to be angled with respect to ground surface 499.

As sole 105 moves to an angled position with respect to ground surface 499, fourth suspension arm 144 and third suspension arm 143 may move substantially independently of sole 105. In particular, lateral portion 107 moves closer to third suspension arm 143, while medial portion 106 moves away from fourth suspension arm 144. Due to the flexibility of fourth suspension arm 144 and third suspension arm 143, fourth stud 144 and third stud 143, respectively, may move substantially independently of sole 105. In particular, third stud 133 may also move closer to lateral portion 107 of sole 105, while fourth stud 134 may move further from medial portion 106 of sole 105. This arrangement allows fourth stud 144 and third stud 143 to remain engaged in ground surface 499. With this arrangement, third stud 133 and fourth stud 134 continue to provide traction for sole 105 as article 100 executes lateral maneuvers.

In some embodiments, first portion 154 of base portion 150 may press downward and contact third suspended arm 143 when article 100 leans toward lateral portion 107. In some cases, upper portion 533 of third stud 133 may be configured with a shape that conforms to first side portion 164. In one embodiment, upper portion 533 may be configured with a curved shape to accommodate the curvature of first side portion 164. This allows first side portion 164 to press smoothly against upper portion 533 when first portion 154 presses against third suspension arm 143. With this configuration, third suspension arm 143 and third stud 133 can provide stability as first portion 154 of base portion 150 presses against third suspension arm 143. It should be understood that the remaining studs of plurality of studs 130 may be configured with substantially similar upper portions.

Figure 6:
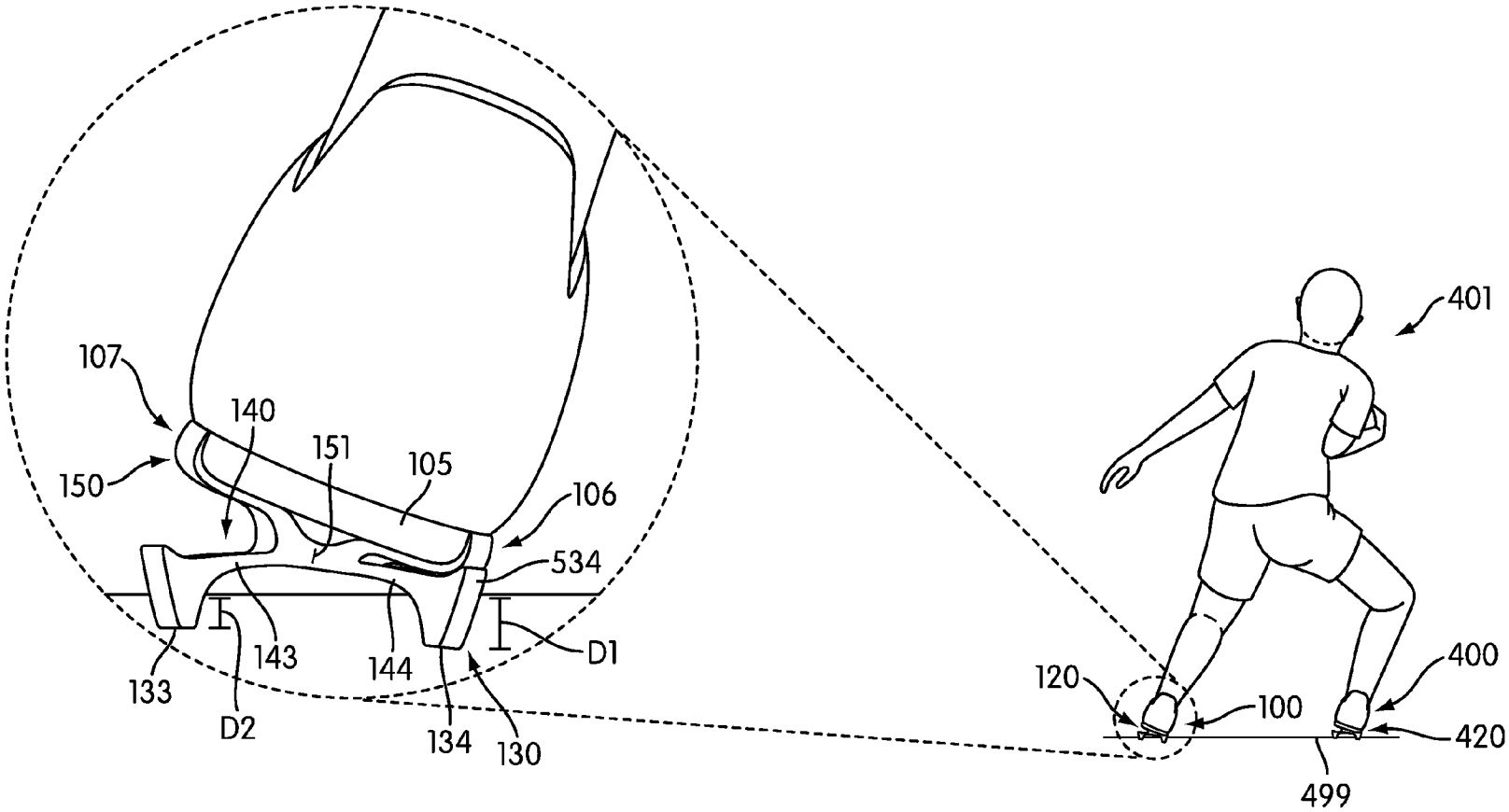
FIG. 6 is a schematic view of an exemplary embodiment of an athlete leaning toward a right side with an enlarged view of a suspended stud assembly attached to an article of footwear.

FIG. 6 illustrates another embodiment of an athlete performing an athletic maneuver. Referring to FIG. 6, athlete 401 performs a lateral maneuver to a right side with both feet planted in ground surface 499. In some cases, article 400 associated with a right foot may lean toward a lateral side as athlete 401 moves to the right. In one embodiment, suspended stud assembly 420 may continue to provide traction to article 400 in a substantially similar manner as suspended stud assembly 120 of the previous embodiment. In addition, article 100 may lean toward medial portion 106 of sole 105 as athlete 401 moves laterally.

As sole 105 leans toward medial portion 106, third suspension arm 143 and fourth suspension arm 144 move substantially independently of sole 105. In particular, medial portion 106 of sole 105 moves closer to fourth suspension arm 144, while lateral portion 107 of sole 105 moves away from third suspension arm 143. Due to the flexibility of fourth suspension arm 144 and third suspension arm 143, fourth stud 134 and third stud 133, respectively, may move substantially independently of sole 105. In particular, third stud 133 may move away from lateral portion 107, while fourth stud 134 may move closer to medial portion 106. This arrangement allows fourth stud 144 and third stud 143 to remain engaged in ground surface 499. With this arrangement, third stud 133 and fourth stud 134 continue to provide traction for sole 105 as article 100 executes lateral maneuvers.

In this exemplary embodiment, the weight applied by an athlete to medial portion 106 of sole 105 causes fourth stud 134 to penetrate further into ground surface 499 than third stud 133. In this exemplary embodiment, fourth stud 134 has penetrated ground surface 499 by a depth D1. In contrast third stud 133 has penetrated ground surface 499 by a depth D2 that is substantially shallower than depth D1. In this case, fourth suspension arm 144 is deflected downwards towards ground surface 499, while third suspension arm 143 remains in a substantially horizontal position that is approximately parallel with ground surface 499. In other words, fourth suspension arm 144 is deflected by a greater amount with respect to central portion 151 than third suspension arm 143 due to the downward force applied to fourth suspension arm 144 by medial portion 106 of sole 105.

Although not illustrated in FIGS. 5 and 6, for purposes of clarity, it should be understood that first stud 131 of first suspension arm 141 and second stud 132 of second suspension arm 142 may also move substantially independently of each other and sole 105 during lateral maneuvers. This substantially independent movement may allow first stud 131 and second stud 132 to maintain engagement with a ground surface while article 100 executes lateral maneuvers.

In some embodiments, second portion 155 may contact fourth suspension arm 144 as article 100 leans toward medial portion 106 of sole 105. In one embodiment, fourth stud 144 may be configured with upper portion 534. Upper portion 534 may be configured to conform to second side portion 165. This can allow fourth stud 134 and fourth suspended arm 144 to cradle second portion 155 and second side portion 165 as second portion 155 presses against fourth suspension arm 144. With this configuration, suspended stud assembly 120 can provide stability and traction for article 100 as athlete 401 executes a lateral maneuver.

During forward and backward movements, portions of a sole of an article may be lifted from or angled with respect to a ground surface. With the substantially independent motion of a set of suspension arms, a plurality of studs of suspended stud assembly may move substantially independently of each other and the sole to continue to penetrate a ground surface when portions of a sole are lifted or angled with respect to a ground surface.

Figure 7:
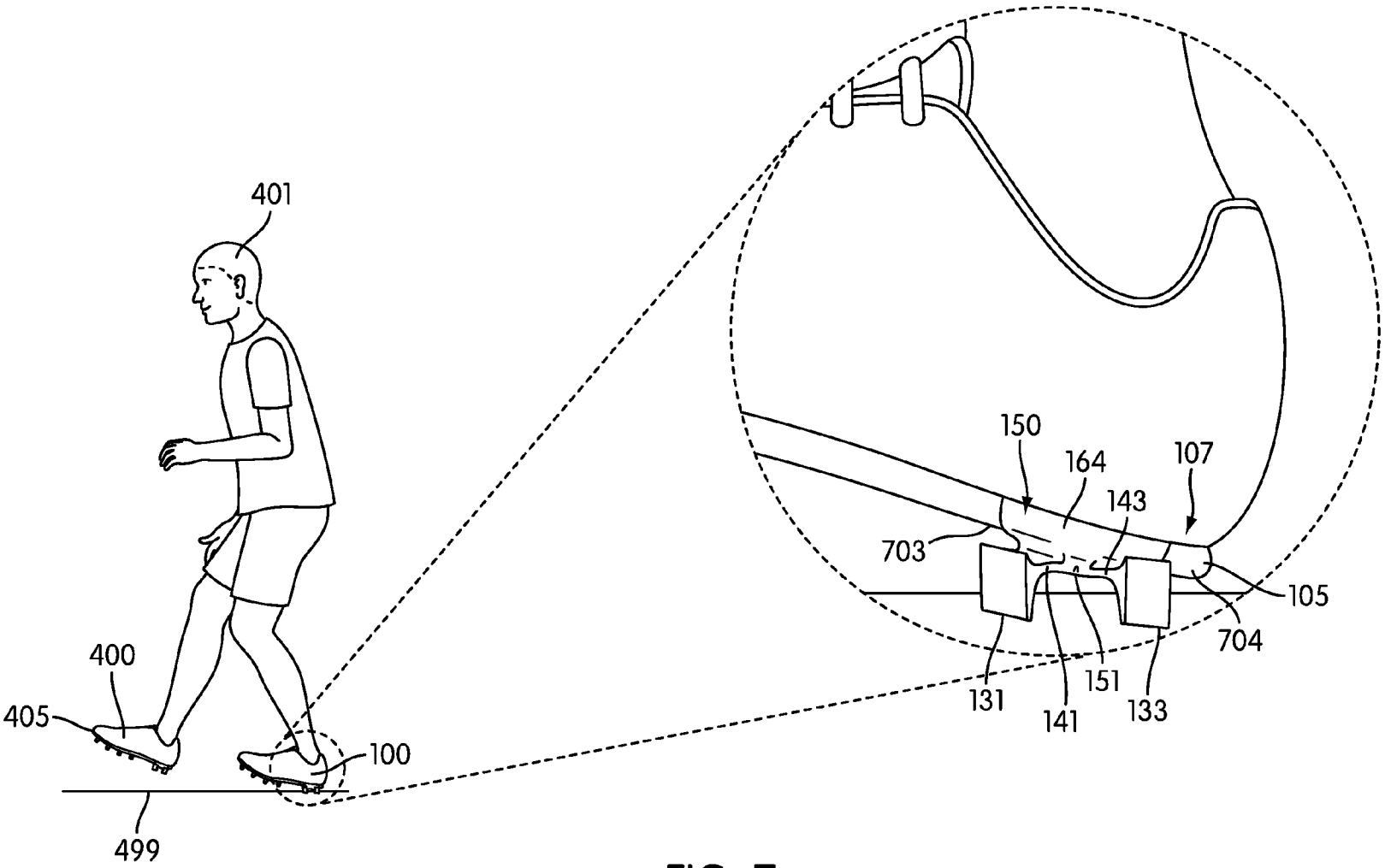
FIG. 7 is a schematic view of an exemplary embodiment of an athlete backpedaling with an enlarged view of a suspended stud assembly attached to an article of footwear.

Referring to FIG. 7, athlete 401 is backpedaling with article 400 elevated and moving rearwards as a portion of article 100 is contacting ground surface 499. In particular, an enlarged view of heel portion 104 of article 100 shows heel portion 104 extended at an angle that elevates forward portion 703 of heel portion 104 higher than rearward portion 704 of heel portion 104.

As sole 105 leans toward rearward portion 704, first suspension arm 141 and third suspension arm 143 move substantially independently of sole 105. In particular, first suspension arm 141 may not rise above ground surface with forward portion 703 of heel 104. The flexibility of central portion 151 allows first suspension arm 141 to flex and move substantially independently of sole 105. In addition, third suspension arm 143 does not move with sole 105 as sole 105 presses downward on third suspension arm 143. Instead, with the flexibility of central portion 151, third suspension arm 143 may remain fixed in place as sole 105 moves.

The movement of first suspension arm 141 and third suspension arm 143 allows first stud 131 and third stud 133, respectively, to move substantially independently of sole 105. In addition, first stud 131 and third stud 133 may move substantially independently of each other. This allows first stud 131 and third stud 133 to remain penetrating ground surface 499 while under different directional forces. With this arrangement, first stud 131 and third stud 133 continue to provide traction for sole 105 during backpedaling movements.

Although not illustrated in FIG. 7, it should be understood that second stud 132 and fourth stud 134 may also move substantially independently of each other and sole 105 as sole 105 is angled with respect to ground surface 499. In particular, the substantially independent movement of second suspension arm 142 and fourth suspension arm 144 from sole 105 may allow second stud 132 and fourth stud 134 to remain penetrating ground surface 499. With this arrangement, second stud 132 and fourth stud 134 can provide traction with ground surface 499 as sole 105 is angled with respect to ground surface 499.

An article may include provisions for controlling the movement of a suspended stud assembly. In some embodiments, an article may include an insert to modify the flexibility of the suspended stud assembly. In some cases, the insert may prevent extreme bending between suspension arms and a base portion. In other cases, the insert may help control the degree of bending between the suspension arms and the base portion. With this arrangement, an insert may provide greater control of the suspended stud assembly to an athlete.

Figure 8:
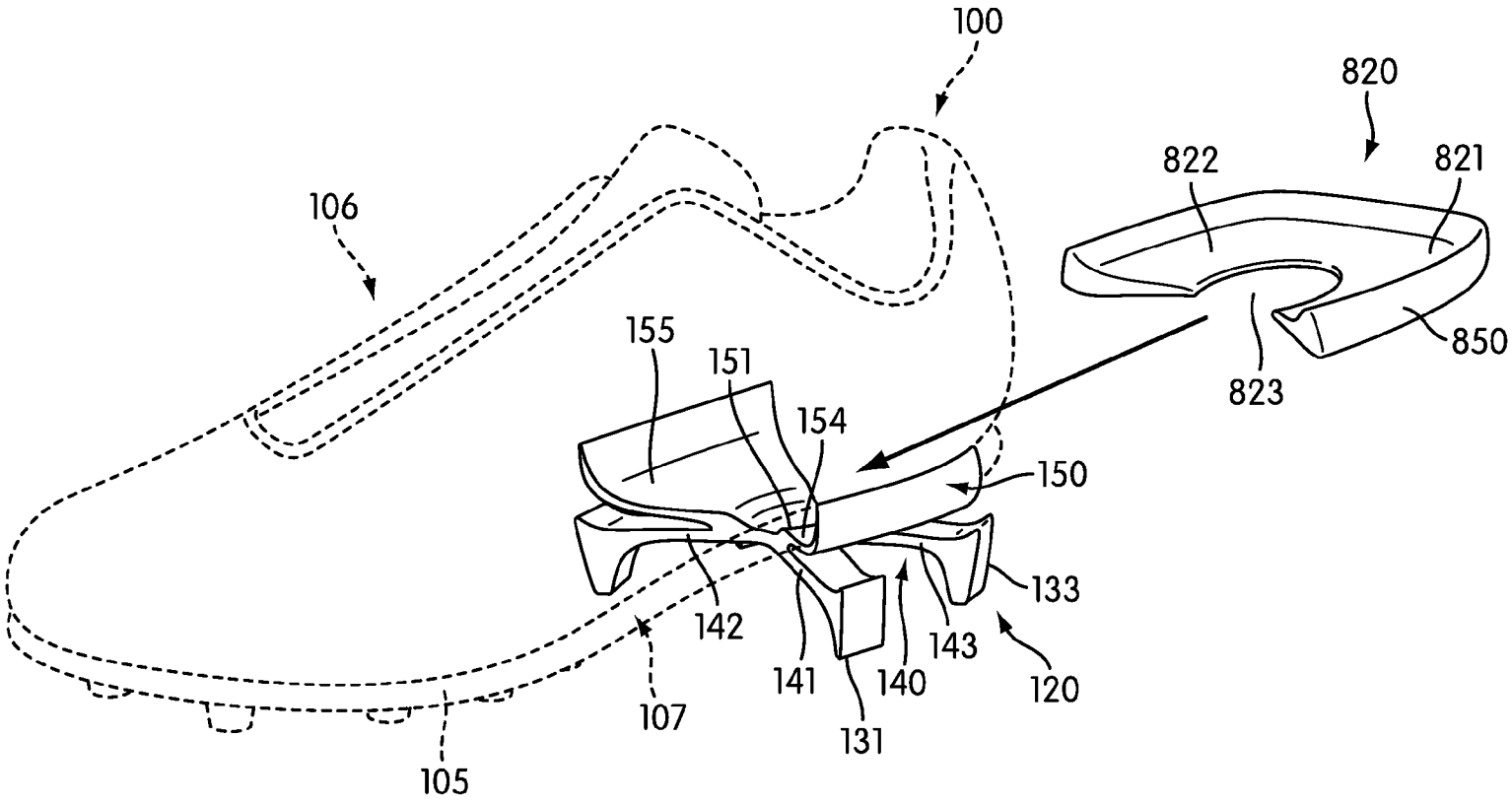
FIG. 8 is an isometric view of an exemplary embodiment of foam pad associated with a suspended stud assembly attached to an article of footwear illustrated in phantom.
Figure 9:
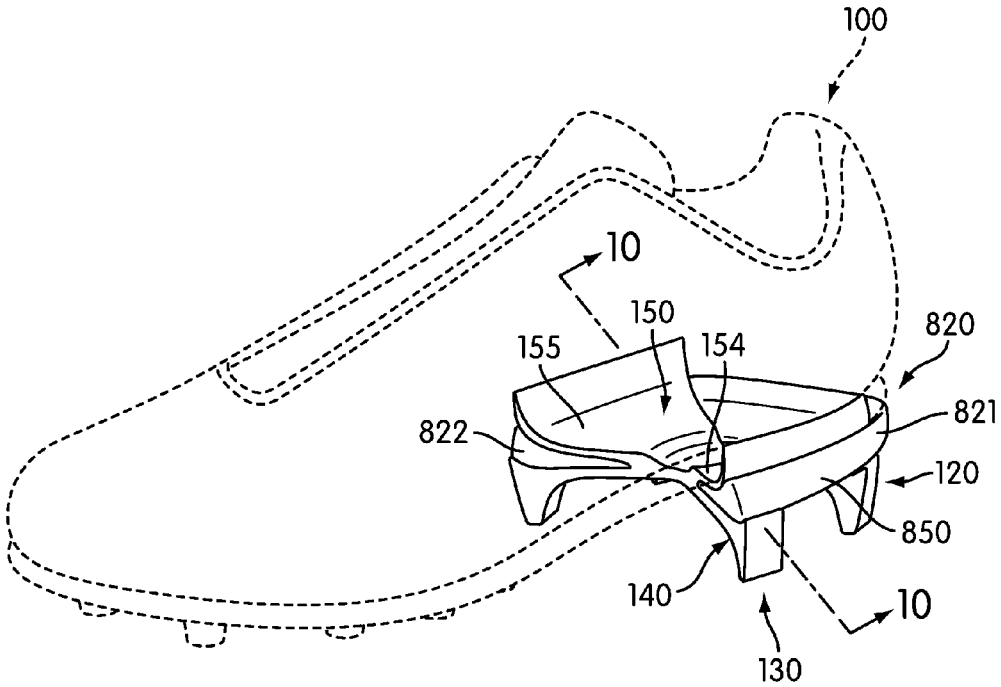
FIG. 9 is an isometric view of an exemplary embodiment of a foam pad inserted within a suspended stud assembly attached to an article of footwear illustrated in phantom.
Figure 10:
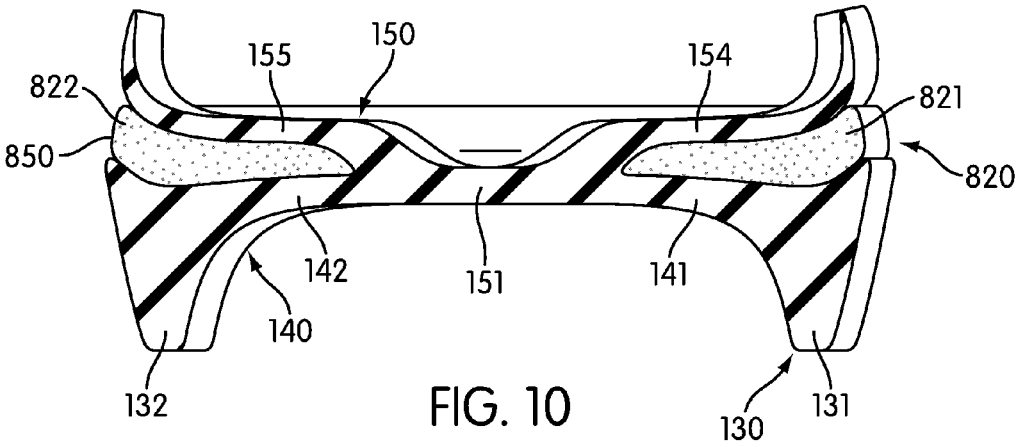
FIG. 10 is a cross sectional view of an exemplary embodiment of a foam pad and a suspended stud assembly.

FIGS. 8-10 illustrate an exemplary embodiment of insert 820 associated with article 100 and suspended stud assembly 120. In different embodiments, insert 820 may be configured in various shapes and sizes. Examples of shapes include, but are not limited to: horseshoe-like shapes, square shapes, rectangular shapes, elliptical shapes, triangular shapes, regular shapes, irregular shapes as well as other types of shapes. In one embodiment, insert 820 may be configured with a horseshoe-like shape.

Referring to FIG. 8, insert 820 includes first portion 821 and second portion 822. Insert 820 also includes central cutout portion 823. Central cutout portion 823 may be disposed between first portion 821 and second portion 822. In some cases, central cutout portion 823 may be configured to receive central portion 151 of base portion 150.

Referring to FIGS. 8-10, insert 820 may be inserted between base portion 150 and set of suspension arms 140. This arrangement disposes first portion 821 adjacent to first portion 154 of base portion 150 as well as first suspension arm 141 and third suspension arm 143. Likewise, second portion 822 may be disposed adjacent to second portion 155 of base portion 150 as well as second suspension arm 142 and fourth suspension arm 144, not visible in these Figures. Furthermore, central cutout portion 823 may receive central portion 151.

In some embodiments, insert 820 may be fixedly attached to suspended stud assembly 120 following insertion of insert 820. In some cases, insert 820 may be attached to suspended stud assembly 120 by adhesives. In other embodiments, insert 820 may be releasably attached to suspended stud assembly 120.

Generally, insert 820 may be constructed of any suitable material. Examples of suitable materials include, but are not limited to, elastomers, siloxanes, natural rubber, other synthetic rubbers, natural leather, synthetic leather, foams, or plastics. In an exemplary embodiment, insert 820 may be a foam pad.

In some embodiments, insert 820 may be constructed of a rigid material to prevent a substantial independent movement of set of suspension arms 140. With this arrangement, suspended stud assembly 120 may be configured in a substantially similar manner as a traditional cleat system. In other embodiments, insert 820 may be constructed of a resilient material. By varying the resiliency of a material comprising insert 820, insert 820 may be configured to modify the bending between set of suspension arms 140 and base portion 150 in different manners. In one embodiment, insert 820 may be configured with a resilient material.

In different embodiments, insert 820 may be configured with varying thicknesses. In some cases, the thickness of insert 820 may vary over different portions of insert 820. By varying the thickness of insert 820, insert 820 may be configured to modify the bending between set of suspension arms 140 and base portion 150 in different manners. In one embodiment, insert 820 may be configured with a greater thickness on outer periphery 850 of insert 820. This can moderate more extreme bending of set of suspension arms 140.

Referring to the cross sectional view of FIG. 10, insert 820 may modify the bending between set of suspension arms 140 and base portion 150. In particular, insert 820 may moderate the bending of set of suspension arms 140 toward base portion 150. In addition, insert 820 may prevent base portion 150 from contacting set of suspension arms 140 when base portion 150 presses against set of suspension arms 140. As previously discussed with regards to FIGS. 5-7, set of suspension arms 140 may bend toward base portion 150 during lateral, forward and backward movements. Using this configuration, insert 820 can provide greater stability to article 100, as illustrated in FIG. 9, during lateral, forward and backward movements.

During lateral, forward and backward movements, set of suspension arms 140 may also move away from base portion 150. In embodiments where insert 820 comprises a resilient material, insert 820 may not affect movements of set of suspension arms 140 away from base portion 150. In other words, set of suspension arms 140 may continue to move substantially independently when base portion 150 moves away from a ground surface. This arrangement may allow plurality of studs 130 to maintain traction with a ground surface when base portion 150 moves away from a ground surface. With this arrangement, insert 820 can provide greater stability to article 100 without interfering with the movement of set of suspension arms 140 that allows plurality of studs 130 to move substantially independently from sole 105.

Figure 11:
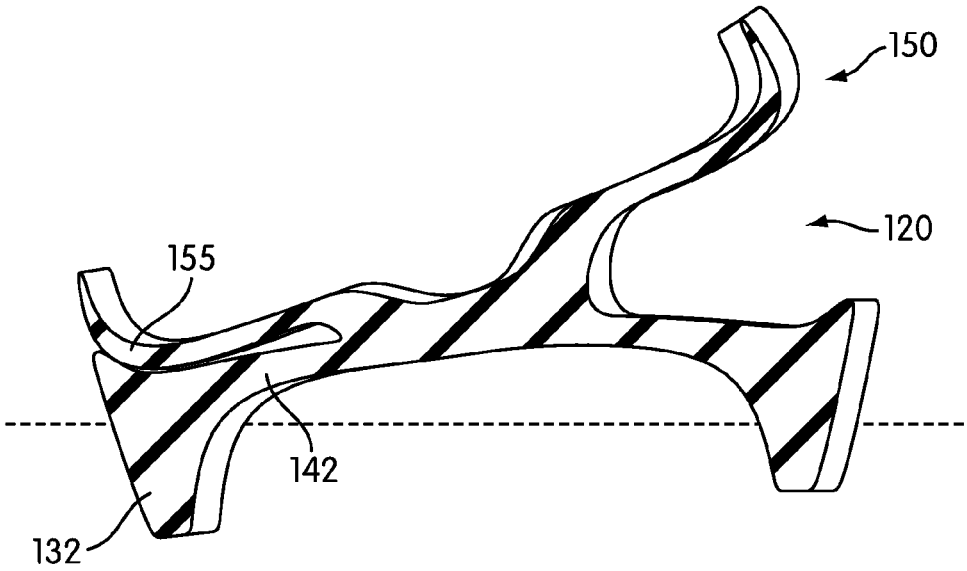
FIG. 11 is a cross sectional view of an exemplary embodiment of a sole leaning towards a lateral side.
Figure 12:
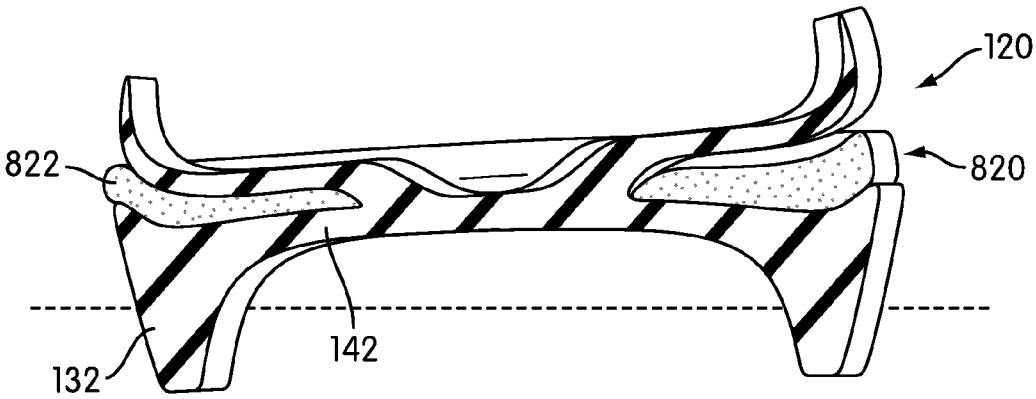
FIG. 12 is a cross sectional view of an exemplary embodiment of a sole with an insert leaning towards a lateral side.

FIGS. 11 and 12 illustrate embodiments of a suspended stud assembly with and without a foam insert. Referring to FIG. 11, which is similar to the enlarged view of FIG. 6, article 100 is tilting in a lateral direction. In this case, suspended stud assembly 120 may undergo a first degree of bending. In some cases, second portion 155 of base portion 150 may contact second suspension arm 142 and second stud 132.

Referring to FIG. 12, the use of insert 820 may moderate the bending of suspended stud assembly 120. In some cases, suspended stud assembly 120 may undergo a second degree of bending. In particular, second portion 822 of insert 820 may prevent second portion 155 of base portion 150 from contacting second suspension arm 142 and second stud 132. In some cases, second portion 822 may partially depress to allow for some deformation of suspended stud assembly 120. In some cases, this arrangement may prevent sole 105 from fully rotating to the lateral side.

By providing a user with an optional insert, the user can choose whether or not an insert is desired for performing a particular athletic activity. For example, an insert may be used in a situation where a suspended stud assembly may not penetrate very far into a ground surface, as can occur with some types of synthetic turf. In this situation, the insert can help reduce the degree of bending that one or more suspension arms may undergo during various maneuvers. In another example, a foam insert can be removed in a situation where maximum traction is desired. In this case, using a suspended stud assembly without an insert allows for maximum deformation of each suspension arm and increases the ability of each stud to move independently in order to retain maximum traction during various maneuvers.

Figure 13:
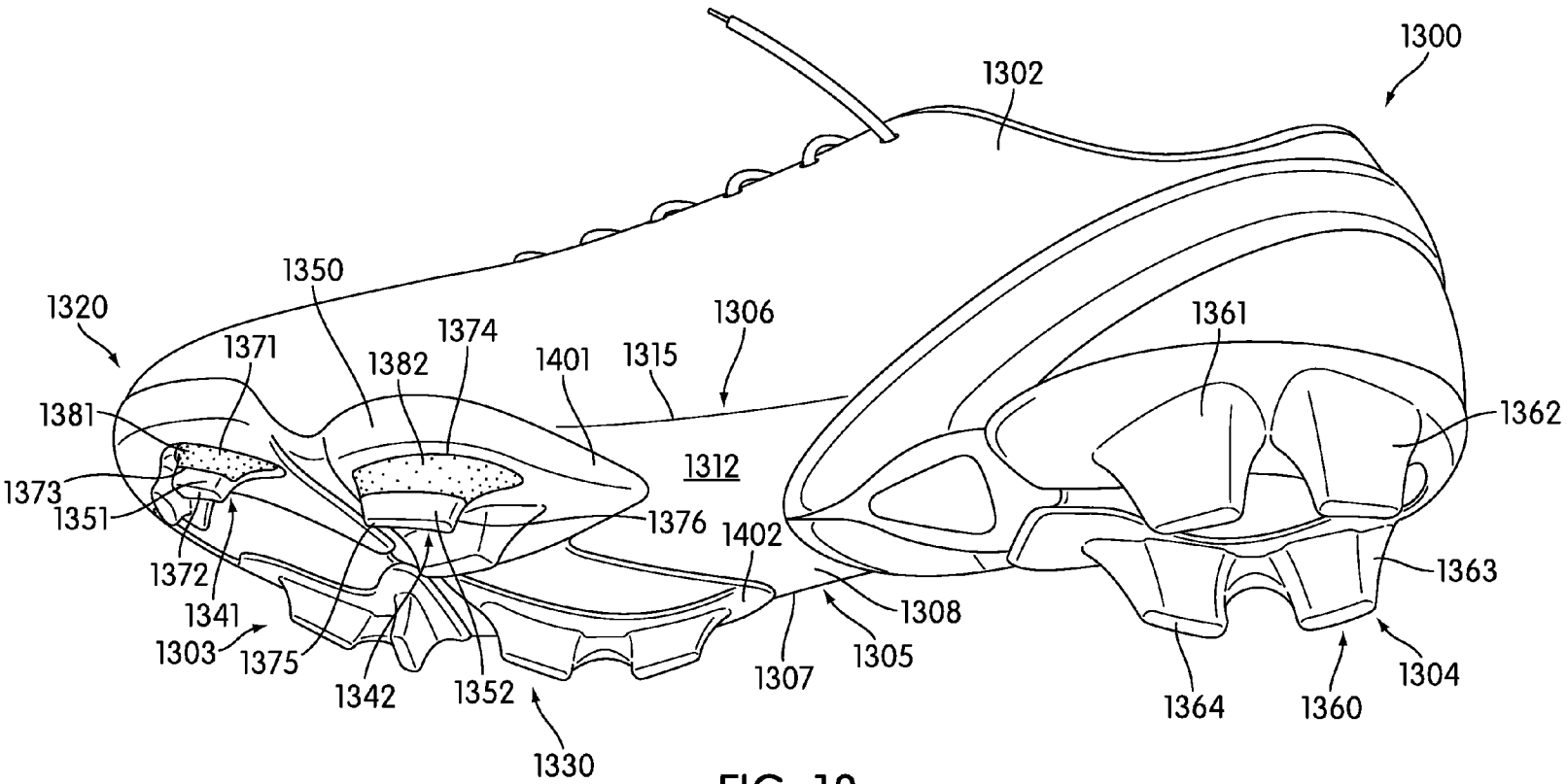
FIG. 13 is a bottom isometric view of an exemplary embodiment of a suspended stud assembly associated with an article of footwear.
Figure 14:
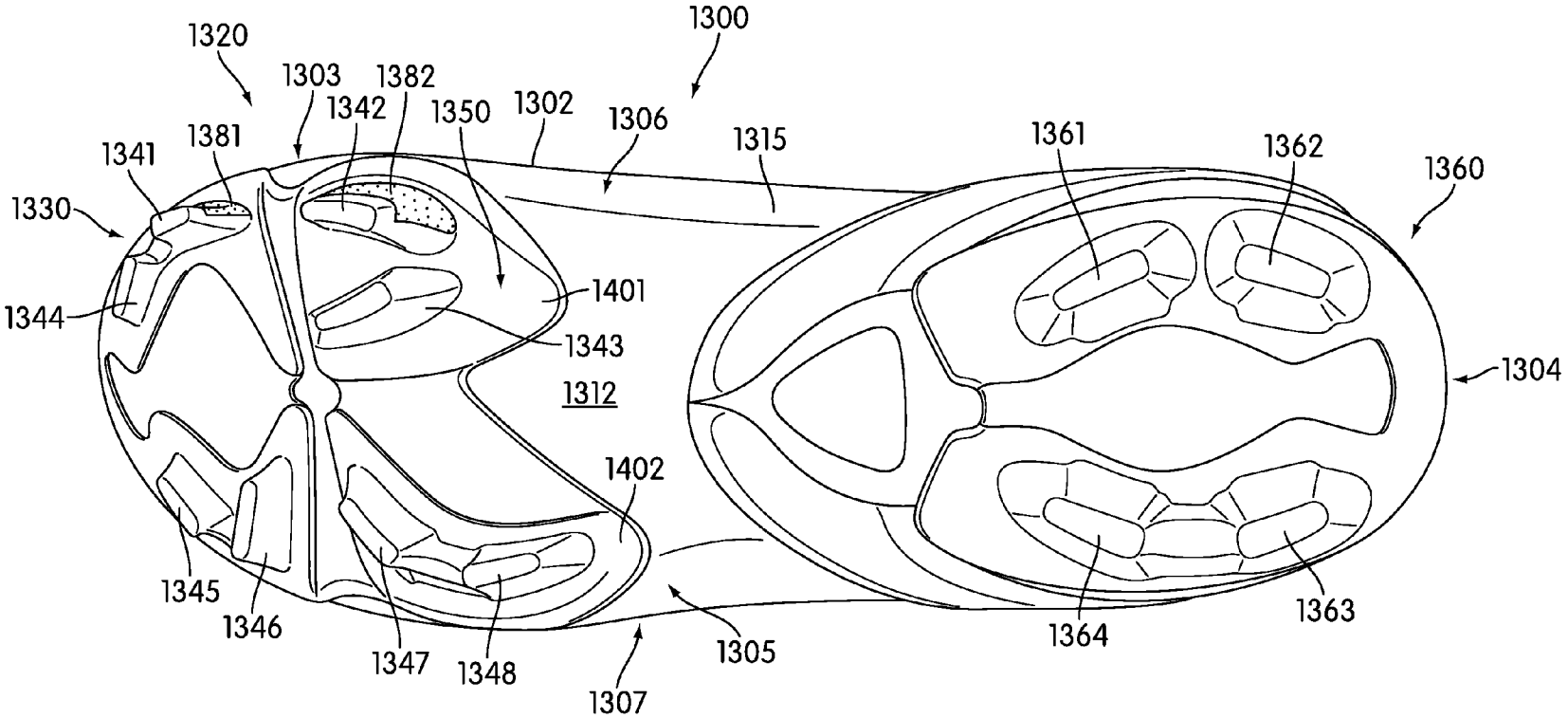
FIG. 14 is a bottom plan view of an exemplary embodiment of a suspended stud assembly associated with an article of footwear.
Figure 15:
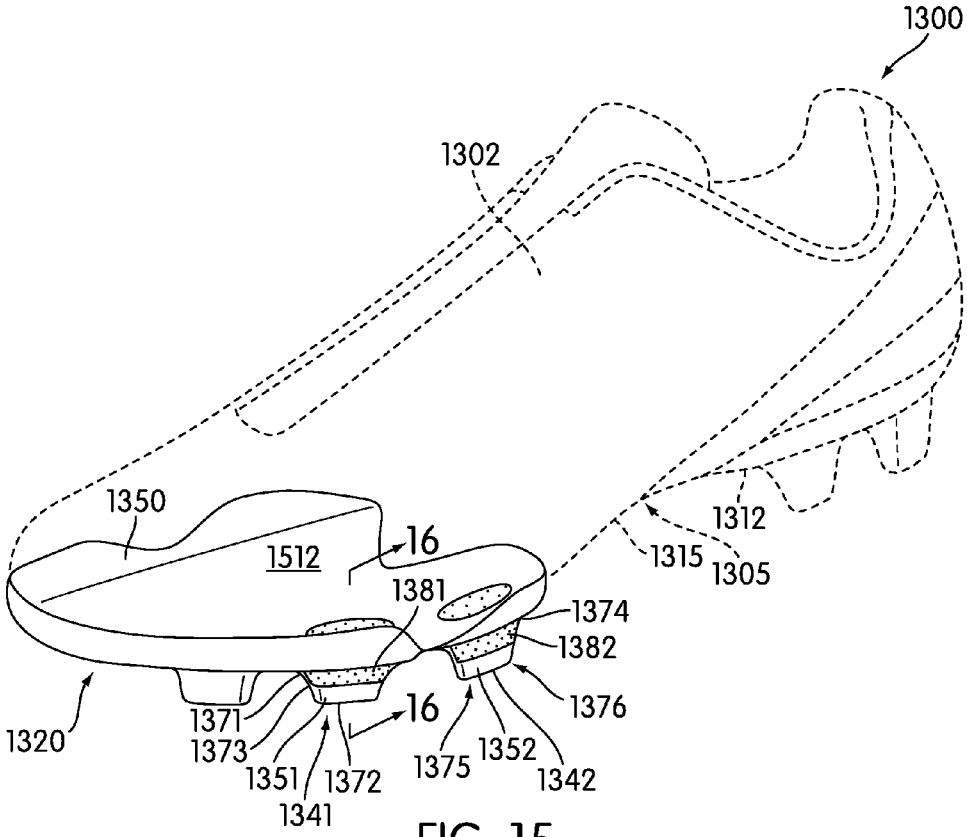
FIG. 15 is an isometric view of an exemplary embodiment of a suspended stud assembly associated with an article of footwear illustrated in phantom.

FIGS. 13-15 illustrate an exemplary embodiment of article 1300. In particular, FIG. 13 is an isometric view of an exemplary embodiment of article 1300; FIG. 14 is a bottom view of an exemplary embodiment of article 1300 and FIG. 15 is a phantom view of an exemplary embodiment of article 1300. For clarity, the following description discusses an exemplary embodiment, in the form of a soccer shoe, but it should be noted that the present invention could take the form of any article of footwear including, but not limited to, hiking boots, soccer shoes, football shoes, sneakers, rugby shoes, baseball shoes as well as other kinds of shoes. As shown in FIGS. 13-15, article of footwear 1300, also referred to simply as article 1300, is intended to be used with a right foot; however, it should be understood that the following discussion may equally apply to a mirror image of article of footwear 1300 that is intended for use with a left foot.

Article of footwear 1300 includes upper 1302. Upper 1302 could have any design, shape, size and/or color. In addition, article of footwear 1300 also comprises sole 1305. In different embodiments, sole 1305 may include different components. For example, sole 1305 may include an outsole, midsole and/or insole.

In one embodiment, sole 1305 includes lower surface 1312. In some cases, lower surface 1312 may be configured to contact a ground surface. Sole 1305 also includes outer peripheral edge 1315. In some cases, outer peripheral edge 1315 may extend between lower surface 1312 and upper 1302 on an outer portion of sole 1305.

In some embodiments, sole 1305 includes forefoot portion 1303 that may be associated with a forefoot of a foot. Similarly, sole 1305 includes heel portion 1304 that may be associated with a heel of a foot inserted within article 1300. Sole 1305 also includes arch portion 1308 disposed between forefoot portion 1303 and heel portion 1304.

Sole 1305 can also comprise medial portion 1306. Medial portion 1306 may be associated with an inside of a foot. In addition, sole 1305 can comprise lateral portion 1307 disposed opposite of medial portion 1306. Lateral portion 1307 may be associated with an outside of a foot.

As previously discussed, a sole can include provisions for increasing traction with a ground surface. In some embodiments, a sole may be associated with a suspended stud assembly. Using this arrangement, the suspended stud assembly can increase the traction capabilities of a sole.

Referring to FIGS. 13-15, sole 1305 may be associated with suspended stud assembly 1320. In different embodiments, suspended stud assembly 1320 may be associated with different portions of sole 1305. In an exemplary embodiment, suspended stud assembly 1320 may be associated with forefoot portion 1303 of sole 1305.

In order to provide traction, suspended stud assembly 1320 may include plurality of studs 1330. In different embodiments, plurality of studs 1330 may comprise various numbers of studs. In some embodiments, plurality of studs 1330 may include more than eight studs. In other embodiments, plurality of studs 1330 may comprise less than eight studs. In one embodiment, plurality of studs 1330 comprises eight studs. Referring to FIG. 14, plurality of studs 1330 includes first stud 1341, second stud 1342, third stud 1343, fourth stud 1344, fifth stud 1345, sixth stud 1346, seventh stud 1347 and eighth stud 1348.

Generally, studs of plurality of studs 1330 may be configured in various shapes including, but not limited to, cylindrical, shark-fin, wedge, rounded and various prism shapes. In an exemplary embodiment, plurality of studs 1330 may include studs configured with truncated wedge-like shapes. In particular, a first end portion of a stud may be wider than a second end portion of a stud. For example, referring to FIG. 13, first stud 1341 includes first end portion 1371 and second end portion 1372. First end portion 1371 may be disposed adjacent to sole 1305. Similarly, second end portion 1372 may be configured to engage a ground surface. In one embodiment, first end portion 1371 may be wider in a generally longitudinal direction than second end portion 1372. Furthermore, in some cases, intermediate portion 1373 of first stud 1341, disposed between first end portion 1371 and second end portion 1372, may be narrower than first end portion 1371 and wider than second end portion 1372.

In some embodiments, plurality of studs 1330 may be associated with a central portion and a peripheral portion of forefoot portion 1303. Referring to FIG. 14, first stud 1341, second stud 1342 and fourth stud 1344 may be disposed adjacent to a peripheral portion of medial portion 1306 of forefoot portion 1303. Similarly, fifth stud 1345, sixth stud 1346, seventh stud 1347 and eighth stud 1348 may be disposed adjacent to a peripheral portion of lateral portion 1307 of forefoot portion 1303. In addition, third stud 1343 may be disposed inward of second stud 1342 adjacent to a central portion of forefoot portion 1303. In some cases, third stud 1343 may be associated with a ball portion of a foot. Using this configuration, plurality of studs 1330 may be associated with a peripheral as well as central portion of forefoot portion 1303.

A plurality of studs may be associated with a base portion of a suspended stud assembly. Referring to FIGS. 13-15, plurality of studs 1330 may be associated with base portion 1350 of suspended stud assembly 1320. In some embodiments, a first end portion of each stud of plurality of studs 1330 may be associated with base portion 1350. In one embodiment, a first end portion of each stud of plurality of studs 1330 may be fixedly attached to base portion 1350. However, in other embodiments, plurality of studs 1330 may be associated with base portion 1350 in another manner. For example, in some cases, plurality of studs 1330 may be releasably attached to base portion 1350.

Generally, base portion 1350 may comprise various shapes. In some embodiments, base portion 1350 may have a substantially similar shape as forefoot portion 1303 of sole 1305. In other embodiments, base portion 1350 may be configured with a shape different than forefoot portion 1303. For example, in some cases, base portion 1350 may be configured with gaps to increase the flexibility of forefoot portion 1303. In other cases, base portion 1350 may extend toward arch portion 1308 of sole 1305.

In one embodiment, base portion 1350 may be configured with a shape substantially similar to forefoot portion 1303. However, base portion 1350 may also include medial protruding portion 1401 and lateral protruding portion 1402. Medial protruding portion 1401 may be a substantially triangular-like shape that protrudes toward medial portion 1306 of arch portion 1308. In some cases, medial protruding portion 1401 may be associated with second stud 1342 and third stud 1343, as illustrated in FIG. 14. Similarly, lateral protruding portion 1402 may be a substantially triangular-like shape that protrudes toward lateral portion 1307 of arch portion 1308. In some cases, lateral protruding portion 1402 may be associated with seventh stud 1347 and eighth stud 1348, as illustrated in FIG. 14.

In different embodiments, base portion 1350 may be attached to different portions of sole 1305. In one embodiment, upper surface 1512 of base portion 1350 may be attached to lower surface 1312 and outer peripheral edge 1315 of sole 1305, as illustrated in FIGS. 14 and 15. This arrangement allows the movement of base portion 1350 to be fixed with respect to sole 1305. With this arrangement, base portion 1350 may provide stability for suspended stud assembly 1320.

In some embodiments, sole 1305 may include additional provisions for traction. For example, in one embodiment, sole 1305 may include heel stud system 1360. Referring to FIGS. 13-14, heel stud system 1360 may comprise first heel stud 1361, second heel stud 1362, third heel stud 1363 and fourth heel stud 1364. With this arrangement, heel stud system 1360 can provide traction for heel portion 1304 of sole 1305.

As previously discussed, a suspended stud assembly can include provisions for the substantially independent movement of a plurality of studs to increase the traction capabilities of a sole. In some embodiments, a set of suspension arms of a suspended stud assembly may allow substantially independent movement of a plurality of studs. In other embodiments, a stud of a plurality of studs may include a stud insert that allows substantially independent movement of the stud. In some cases, the flexibility of the stud insert can enable substantially independent movement of the stud. Using this configuration, the stud insert may allow substantially independent movement of the stud to increase the traction capabilities of the suspended stud assembly associated with a sole.

In embodiments with stud inserts, various configurations of a plurality of studs may be associated with stud inserts. For example, in some embodiments, each stud of a plurality of studs may include a stud insert. In other embodiments, a subset of a plurality of studs may include a stud insert. By associating stud inserts with a subset of the plurality of studs, the traction capabilities of a sole can be fine tuned to accommodate the needs of a particular article of footwear.

Referring to FIGS. 13-15, first stud 1341 and second stud 1342 may be configured with stud inserts. In particular, first stud 1341 includes first stud insert 1381. Likewise, second stud 1342 can include second stud insert 1382. With this configuration, stud inserts may be associated with studs disposed on a peripheral portion of medial portion 1306 of sole 1305.

A stud may be configured with a stud insert in various manners known in the art. In some embodiments, a stud may comprise an integral stud portion and a stud insert. This configuration allows the integral stud portion to receive the stud insert.

In different embodiments, different portions of an integral stud portion may receive a stud insert. For example, in one embodiment, an integral stud portion may receive a stud insert at an intermediate portion of the stud. This arrangement can facilitate substantially independent movement of a first end portion with respect to a second end portion of a stud. Furthermore, in some cases, the stud insert may extend through a first end portion of the stud and into a base portion of a suspended stud assembly. Using this configuration, the stud insert can provide substantially independent movement of a second end portion with respect to the base portion of the suspended stud assembly.

Figure 16:
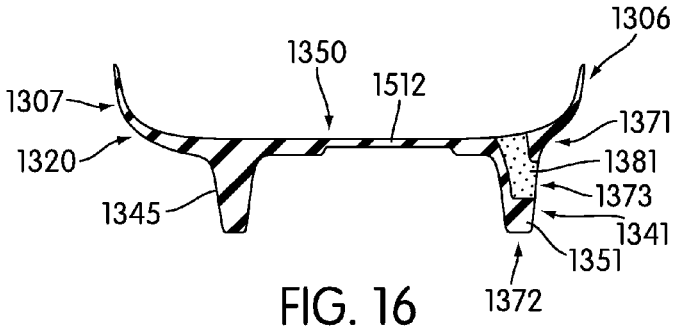
FIG. 16 is a cross sectional view of an exemplary embodiment of a suspended stud assembly associated with an article of footwear.

Referring to the cross sectional view illustrated in FIG. 16, first stud 1341 includes first integral stud portion 1351. In different embodiments, first integral stud portion 1351 may be configured with various shapes. In one embodiment, first integral stud portion 1351 may comprise a substantial entirety of second end portion 1372 of first stud 1341. In addition, first integral stud portion 1351 may have a narrow shape adjacent to intermediate portion 1373 and first end portion 1371. In other words, first integral stud portion 1351 may be hollowed out adjacent to intermediate portion 1373 and first end portion 1371. With this configuration, first integral stud portion 1351 may be configured to receive first stud insert 1381.

In some embodiments, first stud insert 1381 may be associated with intermediate portion 1373 and first end portion 1371 of first stud 1341. In particular, first integral stud portion 1351 may receive first stud insert 1381 at intermediate portion 1373 and first end portion 1371. In some cases, first stud insert 1381 may extend into first end portion 1371. Referring to FIG. 15, a portion of first stud insert 1381 may be exposed on upper surface 1512 of base portion 1350 as first stud insert 1381 extends into first end portion 1371. Using this configuration, first stud insert 1381 and first integral stud portion 1351 may comprise first stud 1341.

Referring to FIG. 15, second stud 1342 comprises second integral stud portion 1352 and second stud insert 1382. Furthermore, second stud 1342 comprises first end portion 1374, associated with base portion 1350, and second end portion 1375 that may be configured to engage a ground surface. In addition, second stud 1342 also includes intermediate portion 1376 disposed between first end portion 1374 and second end portion 1375.

In some embodiments, second integral stud portion 1352 and second stud insert 1382 may be configured in a substantially similar manner as first integral stud portion 1351 and first stud insert 1381. In other embodiments, second integral stud portion 1352 and second stud insert 1382 may be configured in a different manner. Referring to FIGS. 13-15, second integral stud portion 1352 may be configured with a narrow shape at first end portion 1374 and intermediate portion 1376. Also, second integral stud portion 1352 may have a wider shape at second end portion 1375. In an exemplary embodiment, second integral stud portion 1352 may comprise a substantial entirety of second end portion 1375. With second integral stud portion 1352 configured with this shape, second stud insert 1382 may extend through intermediate portion 1376 and first end portion 1374. In some cases, second stud insert 1382 may be exposed on a portion of base portion 1350 as second stud insert 1382 extends into first end portion 1374. Using this configuration, second stud insert 1382 and second integral stud portion 1352 may form second stud 1342.

An integral stud portion and a stud insert may comprise various materials. Examples of different materials that may be used include, but are not limited to, polymers, elastomers, siloxanes, natural rubber, other synthetic rubbers, aluminum, steel, other metals, plastics as well as other types of materials. Generally, a stud insert may comprise a material that is resilient so that the stud insert can flex and revert to an original configuration. In some embodiments, the stud insert may be made of a styrene butadiene styrene (SBS) elastomer. In an exemplary embodiment, the stud insert may be made of thermoplastic polyurethane (TPU). In some cases, the integral stud portion may comprise a material that is rigid and does not deform under pressure. In one embodiment, the integral stud portion may be made of a durable plastic.

In different embodiments, portions of a stud may be configured with different relative rigidities. For example, first end portion 1371 of first stud 1341 may be associated with a first rigidity. Likewise, second end portion 1372 may be associated with a second rigidity. As previously discussed, first end portion 1371 comprises both first stud insert 1381 and first integral stud portion 1351. In contrast, second end portion 1372 comprises first integral stud portion 1351. In embodiments where first stud insert 1381 is configured with a greater flexibility than first integral stud portion 1351, the first rigidity may be more flexible than the second rigidity. This increased flexibility of first rigidity can allow second end portion 1372 to move substantially independently of first end portion 1371. Furthermore, second end portion 1372 may move substantially independently of base portion 1350 because of the increased flexibility of first end portion 1371.

Figure 17:
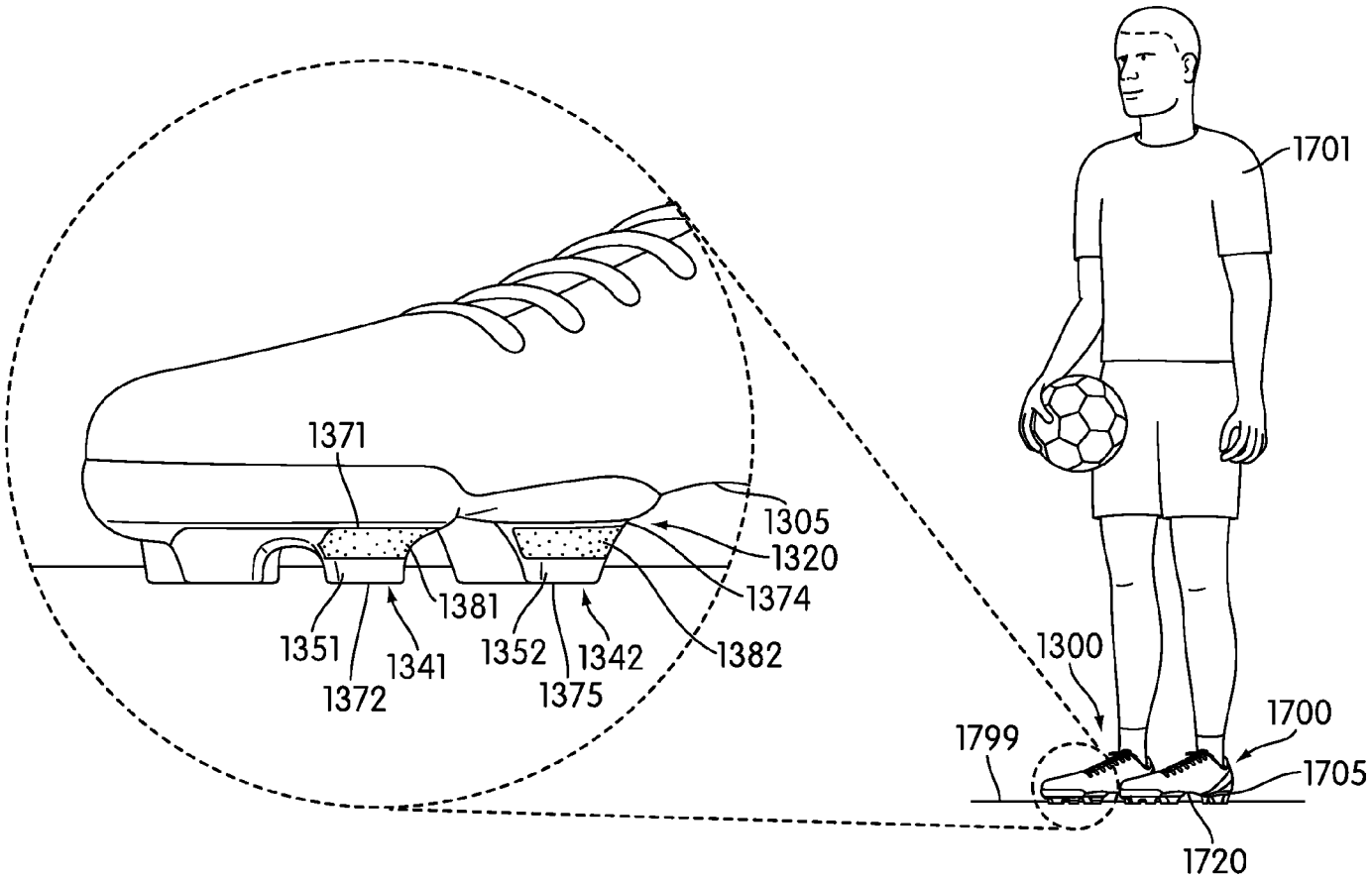
FIG. 17 is a schematic view of an exemplary embodiment of an athlete standing upright with an enlarged view of a suspended stud assembly associated with an article of footwear.
Figure 18:
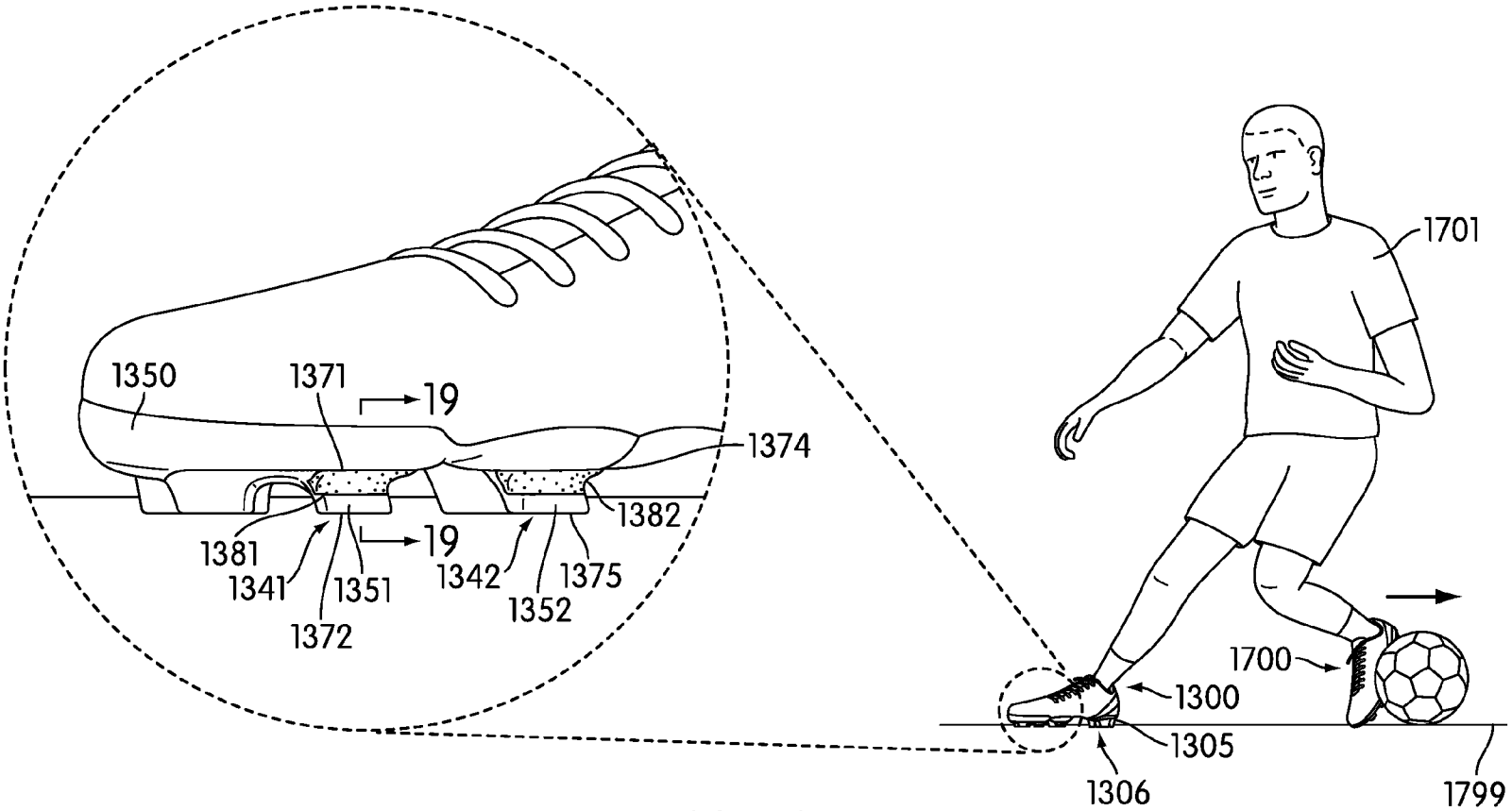
FIG. 18 is a schematic view of an exemplary embodiment of an athlete leaning toward a left side with an enlarged view of a suspended stud assembly attached to an article of footwear.

FIGS. 17-18 illustrate exemplary embodiments of athlete 1701 standing upright as well as performing a lateral maneuver. Although, these embodiments illustrate athlete 1701 as a soccer player, in other embodiments, athlete 1701 may play any sport and may play any position. In these embodiments, athlete 1701 wears article 1300 of the previous embodiment on a right foot. In addition, athlete 1701 may wear article 1700 on a left foot.

Article 1700 may be substantially similar to article 1300 of the previous embodiment. In particular, suspended stud assembly 1720 may be attached to sole 1705 of article 1700. With this arrangement, suspended stud assembly 1720 can provide traction for sole 1705.

Referring to FIG. 17, athlete 1701 is standing in an upright position. As athlete 1701 stands upright, suspended stud assembly 1320 and suspended stud assembly 1720 provide traction for sole 1305 and sole 1705, respectively. For example, second end portion of 1372 of first stud 1341 and second end portion 1375 of second stud 1342 penetrate through ground surface 1799 to provide traction, as illustrated in the enlarged view in FIG. 17. In particular, the rigidity of first integral stud portion 1351 and second integral stud portion 1352 allow second end portion 1372 and second end portion 1375, respectively, to penetrate ground surface 1799. In addition, the remaining studs of plurality of studs 1330 as well as studs associated with suspended stud assembly 1720 may also penetrate through ground surface 1799 to provide traction for athlete 1701. With this arrangement, suspended stud assembly 1320 and suspended stud assembly 1720 provide traction for sole 1305 and 1705, respectively.

It should be noted that first stud insert 1381 and second stud insert 1382 remain relatively rigid and do not bend as athlete 1701 stands in an upright position. In other words, the flexibility of first stud insert 1381 and second stud insert 1382 does not interfere with the traction provided by first stud 1341 and second stud 1342, respectively. However, in some cases, the flexibility of first stud insert 1381 and second stud insert 1382 may provide some cushioning as athlete 1701 stands upright.

As previously discussed, a suspended stud assembly that provides substantially independent movement of one or more studs may continue to provide traction with a ground surface as an athlete performs a lateral maneuver. In embodiments with a stud insert, the flexibility of the stud insert may provide increased contact time for a plurality of studs with a ground surface during lateral maneuvers. The increased contact time with a ground surface provides greater traction for a sole.

Referring to FIG. 18, athlete 1701 performs a lateral maneuver moving toward a left side. As athlete 1701 moves toward the left, article 1700, associated with a left foot, may be elevated from ground surface 1799. In addition, article 1300, associated with a right foot, may lean toward medial portion 1306 of sole 1305. With this arrangement, sole 1305 may be angled with respect to ground surface 1799.

As sole 1305 leans toward medial portion 1306, the flexibility of first stud insert 1381 allows first stud 1341 to bend. In a similar manner, second stud 1342 may also bend due to the flexibility of second stud insert 1382. Furthermore, first stud 1341 and second stud 1342 may move substantially independently of each other as first stud 1341 and second stud 1342 move to accommodate the leaning of sole 1305.

In some embodiments, first stud 1341 and second stud 1342 may pinch at first stud insert 1381 and second stud insert 1382, respectively, as athlete 1701 executes a lateral maneuver. With this pinching, second end portion 1372 and second end portion 1375 move substantially independent of first end portion 1371 and first end portion 1374, respectively. Furthermore, second end portion 1372 and second end portion 1375 can move substantially independently of base portion 1350. This can allow second end portion 1372 of first stud 1341 and second end portion 1375 of second stud 1342 to remain engaged with ground surface 1799 as base portion 1350, secured to sole 1305, leans toward medial portion 1306.

Figure 19:
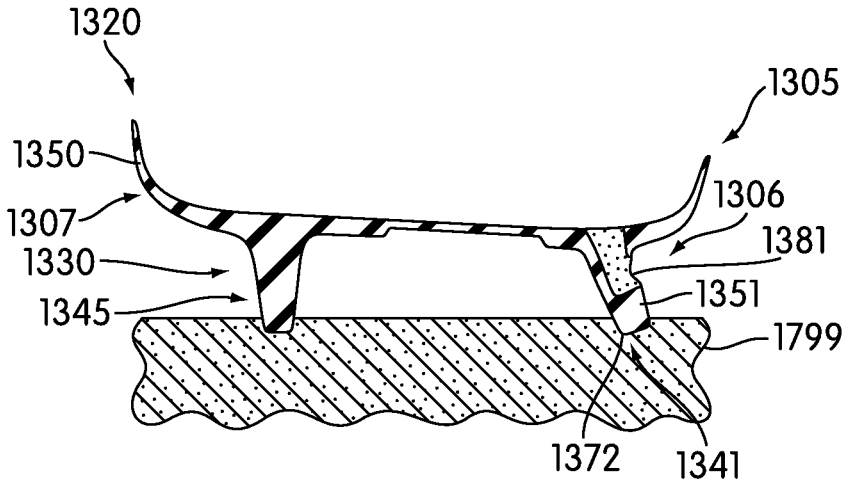
FIG. 19 is a cross sectional view of an exemplary embodiment of a suspended stud assembly associated with a sole leaning toward a side.

In some cases, the bending of a stud insert may allow other studs to remain in contact with a ground surface when a sole leans toward a side. For example, referring to a cross sectional view illustrated in FIG. 19, the bending of first stud insert 1381 of first stud 1341 may allow lateral portion 1307 to remain closer to ground surface 1799 when sole 1305 leans toward medial portion 1306. This can increase contact time of studs disposed on lateral portion 1307 with ground surface 1799. In one example, the bending of first stud 1341 may allow fifth stud 1345 to remain in contact with ground surface 1799 when sole 1305 leans toward medial portion 1306. Although not shown for purposes of clarity, second stud 1342, as illustrated in FIG. 18, may also allow other studs to remain in contact with ground surface 1799 when sole 1305 leans toward medial portion 1306. With this arrangement, the substantially independent movement of first stud 1341 and second stud 1342 can provide greater traction for sole 1305 by increasing contact time for plurality of studs 1330 with ground surface 1799 during lateral maneuvers.

Following a lateral maneuver, first stud insert 1381 and second stud insert 1382 may be resilient and revert to an original configuration. For example, first stud insert 1381 and second stud insert 1382 may straighten when athlete 1701 stands upright after a lateral maneuver, as illustrated in FIG. 17. With this arrangement, first stud 1341 and second stud 1342 may be configured to provide traction during further maneuvers by athlete 1701.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

We claim:

1. An article of footwear, comprising:

a sole including a base portion;

a stud extending from the base portion;

the stud including a first end portion and a second end portion; and wherein the first end portion is configured to move substantially independently of the second end portion;

wherein the stud includes an integral stud portion and a stud insert;

wherein the stud insert is less rigid than the integral stud portion;

wherein the integral stud portion is formed of a material that is contiguous with the base portion of the sole; and wherein the stud insert is disposed horizontally off center within the stud.

2. The article of footwear according to claim 1, further including a second stud extending from the base portion, the second stud including a second integral stud portion and a second stud insert disposed within the second integral stud portion, the second stud insert being less rigid than the second integral stud portion.

3. The article of footwear according to claim 2, wherein the second stud insert is disposed horizontally off center within the second stud.

4. The article of footwear according to claim 1, wherein the stud includes an intermediate portion disposed between the first end portion and the second end portion and wherein the stud insert extends through the intermediate portion and the first end portion.

5. The article of footwear according to claim 4, wherein the stud insert is disposed adjacent to the second end portion.

6. An article of footwear comprising:

a sole including a base portion; and a stud extending from the base portion;

the stud including a first end portion disposed adjacent to the base portion and a second end portion disposed opposite of the first end portion and configured to contact a ground surface, the stud further including an intermediate portion disposed between the first end portion and the second end portion; and the stud including an integral stud portion and a stud insert;

wherein the stud insert extends from the intermediate portion to the base portion and wherein a portion of the stud insert is exposed on an upper surface of the base portion;

wherein the stud insert is less rigid than the integral stud portion;

wherein the stud is disposed on a medial side of the sole; and wherein the stud insert is located on a medial portion of the stud.

7. The article of footwear according to claim 6, wherein the stud is disposed in a forefoot region of the sole.

8. The article of footwear according to claim 6, wherein the stud is configured to deflect with respect to the base portion during lateral maneuvers.

9. The article of footwear according to claim 6, wherein the integral stud portion is contiguous with the base portion of the sole and the stud insert extends into the base portion.

10. The article of footwear according to claim 6, wherein the stud insert is formed from at least one of styrene butadiene styrene and thermoplastic polyurethane.

11. The article of footwear according to claim 6, wherein the stud insert is formed of a resilient material and is configured to flex and revert to an original configuration.

12. The article of footwear according to claim 6, wherein the article of footwear includes a plurality of studs extending from the base portion, and wherein a subset of the plurality of studs include integral stud portions and stud inserts, the stud inserts being less rigid than the integral stud portions.

13. The article of footwear according to claim 12, wherein the studs included in the subset of studs are located in a peripheral portion of the base portion of the sole system on a medial side of the sole system.

14. The article of footwear according to claim 13, wherein the studs included in the subset of studs are located in a forefoot region of the sole system.

* * * * *